US006491326B1

(12) United States Patent
Massey et al.

(10) Patent No.: US 6,491,326 B1
(45) Date of Patent: Dec. 10, 2002

(54) SWING ADAPTABLE ASTRAGAL WITH LOCKABLE UNITARY FLUSH BOLT ASSEMBLIES

(75) Inventors: Victor T. Massey, Greensboro; Brad I. Procton, High Point, both of NC (US)

(73) Assignee: Endura Products, Inc., Calfar, NC (US)

( * ) Notice: Subject to any disclaimer, the term of this patent is extended or adjusted under 35 U.S.C. 154(b) by 0 days.

(21) Appl. No.: 09/541,808

(22) Filed: Apr. 3, 2000

Related U.S. Application Data

(60) Provisional application No. 60/142,583, filed on Jul. 7, 1999.

(51) Int. Cl.[7] ..... E05C 1/04

(52) U.S. Cl. ..... 292/162; 292/42; 292/341.19; 292/DIG. 21; 292/DIG. 51

(58) Field of Search ..... 292/341.19, 340, 292/341.18, 42, 162, 145, 22, 33, DIG. 51, DIG. 53, DIG. 21; 49/365, 366, 395

(56) References Cited

U.S. PATENT DOCUMENTS

| | | | | |
|---|---|---|---|---|
| 3,487,581 | A | 1/1970 | Elingson, Jr. | 49/478 |
| 3,649,060 | A | 3/1972 | Ruff | 292/42 |
| 3,888,046 | A | 6/1975 | Meisterheim | 49/319 |
| 4,489,968 | A | 12/1984 | Easley | 292/340 |
| 5,328,217 | A | 7/1994 | Sanders | 292/341.19 |
| 5,350,207 | A | 9/1994 | Sanders | 292/335 |
| 5,590,919 | A | 1/1997 | Germano | 292/137 |
| 5,603,534 | A | 2/1997 | Fuller | 292/2 |
| 5,857,291 | A | 1/1999 | Headrick | 49/368 |

*Primary Examiner*—Teri Pham Luu
(74) *Attorney, Agent, or Firm*—Womble Carlyle Sandridge & Rice, PLLC

(57) ABSTRACT

An improved astragal assembly for double door entryways includes an extruded aluminum frame into which upper and lower flush bolt assemblies are slidably disposed. The flush bolt assemblies include a relatively long metal bolt about which is injection overmolded a series of retainer guides, which ride in the frame. Locking mechanisms are also integrally overmolded onto the bolts. The frame and all components of the astragal assembly are symmetrical and reversible so that the assembly is non-handed; that is, it can be adapted to both a right hand swing and a left-hand swing inactive door. A unique strike plate mounting system and bottom-sealing block are provided and the upper end of the assembly includes means for sealing against the stop of a head jamb. Drafts at the upper and lower inside corners of the doors of a double door entryway are thus prevented.

22 Claims, 14 Drawing Sheets

SWING ADAPTABLE ASTRAGAL WITH LOCKABLE UNITARY FLUSH BOLT ASSEMBLIES

REFERENCE TO RELATED APPLICATION

This application claims the benefit of the filing date of U.S. provisional application Ser. No. 60/142,583, filed Jul. 7, 1999.

TECHNICAL FIELD

This invention relates generally to double door entryways and more particularly to astragal assemblies mounted along the vertical inside edge of the normally inactive door of such entryways, against which the active door closes.

BACKGROUND

To seal the space between the opposed vertical edges of the active and normally inactive doors of a double door entryway and to provide a stop against which the active door closes, it is common that a generally T-shaped astragal be mounted along the vertical inside edge of the normally inactive door. Such astragals provide the desired stop and usually include a weather strip that engages and seals along the edge of the active door when closed to prevent leakage and drafts. For many years, astragals have been made of milled wood and are generally simple in construction and operation. Some applications still call for wooden astragals. However, many modern astragals are formed with elongated extruded aluminum bodies, which are generally stronger, more durable, and more adaptable than wooden astragals.

To secure the normally inactive door of a double door entryway in its closed position, modern astragals usually are provided with flush bolt assemblies mounted in the astragal at the top and bottom ends thereof. A typical flush bolt assembly includes a metal bolt slidably mounted in the astragal near one of its ends. A mechanism is mounted in the astragal and coupled to the bolt for moving the bolt selectively between a secured position, wherein the bolt projects from the end of the astragal into an opening in the door frame to secure the door, and an unsecured position wherein the bolt is retracted into the astragal for releasing the door. In some cases, locking devices are provided to lock the bolts of a flush bolt assembly in their secured positions so that they can not easily be jimmied or otherwise defeated by a would-be thief with a screwdriver or knife blade.

Some modern astragals also have provisions for securing strike plates and deadbolt strikes to the astragal for receiving the latches and deadbolts of the active door when the active door is closed against the astragal. In some cases, the strike plates and deadbolt strikes are simply positioned at the proper location by an installer, whereupon holes are drilled in the astragal and the strikes are secured with screws. Clearly, this approach has disadvantages in that it is subject to human error and the location of the plates cannot easily be adjusted after they are installed. In other astragals, adjustable strike plate and deadbolt strike mounting means are provided in an effort to overcome such shortcomings.

One example of a relatively modern astragal assembly is disclosed in U.S. Pat. No. 5,328,217 of Sanders. Sanders teaches an astragal with an elongated extruded aluminum body that defines a channel extending therealong. Slidably mounted within the channel are a number of components including top and bottom flush bolt assemblies and screw bosses for receiving screws to mount a strike plate to the astragal. A weather strip is carried by the astragal for sealing against the active door of the entryway when it is closed against the astragal.

The astragal assembly disclosed in Sanders shares a number of problems and shortcomings with other modern astragals. One such problem is that the flush bolt assemblies of these astragals tend to be complex multi-component devices that require relatively complicated production and assembly techniques. Furthermore, because of their multiple component construction, these flush bolt assemblies are highly subject to wear and tear and to consequent failure over time. Probably more significant, however, is that because of the construction and mounting of the bolts, prior art flush bolt assemblies are not as secure against an attempted forced entry as are, for example, a typical dead bolt. In general, this is because when subjected to an abrupt or relatively large lateral force during an attempted forced entry, the moments of inertia generated on the bolts are relatively close to the ends of the astragal and to the ends of the bolts. Accordingly, all of the force is concentrated in relatively small regions of the astragal near its ends. The result in many cases is that the astragal body will simply bend, the bolt assembly break, or both. In any case, the locked inactive door is relatively easily defeated. The same thing can happen under the influence of high winds, which can generate forces similar to those generated during an attempted forced entry.

Other problems with prior art astragal assemblies are that their components generally are not reversible. As a consequence, right hand and left hand swing astragal assemblies and astragal components must be manufactured and stocked to accommodate normally inactive doors that are hinged from either side of the entryway. Also, while modern weather stripping seals well along the edges of the active door, adequate sealing in the regions where the top and bottom of the astragal meet the head jamb and threshold respectively remains a problem.

Thus, a need exists for an improved astragal assembly that successfully addresses the above mentioned and other problems and shortcomings of prior art astragals. It is to the provision of such an astragal assembly that the present invention is primarily directed.

SUMMARY OF THE INVENTION

Briefly described, the present invention, in a preferred embodiment thereof, comprises an improved astragal assembly for mounting to the vertical inside edge of the inactive door of a double door entryway. The astragal assembly includes an elongated extruded aluminum frame having a top end and a bottom end and defining channels extending the length of the frame. Upper and lower flush bolt assemblies are slidably disposed in the channels in the top and bottom portions respectively of the astragal. Each flush bolt assembly is a single piece unit that includes an elongated hardened steel bolt having a first end and a second end and a set of retainer guides unitarily injection overmolded onto the bolt at selected positions therealong, preferably one adjacent each end and one intermediate the ends of the bolt. The bolt and its unitary retainer guides slide as a unit within the frame of the astragal between a secured position wherein the first end of the bolt protrudes from the respective end of the astragal for extension into the casing of an entryway to secure the inactive door, and an unsecured position wherein the first end of the bolt is retracted into the astragal frame channel to free the inactive door.

Preferably, a guide plate is integrally molded with the retainer guide and overmolded onto the bolt adjacent the first end thereof and the bolt protrudes from the end of the guide plate to its free end. A locking mechanism is integrally molded with the retainer guide and overmolded onto the bolt at the second end thereof for selectively locking the flush bolt assembly in its secured position. The locking mechanism includes a locking plug retainer that carries a rotatable locking plug, the locking plug being rotatable between a locked position and an unlocked position. A strike retainer plate is mounted adjacent the locking mechanism and includes an inwardly projecting rib. The locking plug and locking plug retainer are formed with respective central grooves. These grooves are aligned with each other and with the inwardly projecting rib when the locking plug is in its unlocked position to allow the flush bolt assembly to be moved to its unsecured position. When the locking plug is in its locked position, the grooves are misaligned, which blocks movement of the rib through the grooves and locks the flush bolt assembly in its secured position.

A reversible top end plug is insertable in the upper end of the astragal frame to extend the top end slightly to the level of the top edge of the inactive door. The end plug is symmetric and insertable in either end of the astragal frame so that a single end plug configuration is usable in either a left hand or a right hand swing astragal assembly. A head seal is also insertable in the upper end of the astragal frame. The head seal is formed with a plate that covers the open top of the astragal to prevent leakage of water and debris into the astragal and an upstanding flexible sealing tab configured to bear and seal against the stop of the head jamb of the entryway to seal against drafts and the migration of water into a building at the top of the astragal assembly. A U-shaped molded sealing block is mounted to the guide block of the lower flush bolt assembly for sealing against leakage beneath the astragal at the adjacent lower inside corners of the inactive door and active door when the doors are closed. The molded sealing block is movable with the flush bolt assembly and includes a bottom wall through which the bolt extends, an outside wall that bears against the active door when closed, and an inside wall that bears against the inactive door. When the bottom flush bolt assembly is in its secured position, the bottom wall of the sealing block bears and seals against the sill of the entryway and the outside and inside walls of the sealing block continue the seal partially up the abutting inside edges of the two doors. Accordingly, leakage of water in the region of the bottom of the astragal is essentially eliminated, even in blowing rains.

Another aspect of the invention includes a unique strike plate retainer assembly mountable to the astragal for securing strike plates and deadbolt strikes to the astragal. The strike plate retainer assembly includes an elongated retainer plate having an outside face and an inside face and at least one longitudinally extending central opening. The elongated retainer plate is mountable to the astragal at a selected central position therealong. Mounting dogs are located on the inside face of the elongated retainer plate for adjustably securing a strike plate to the retainer plate and to the astragal. Each of the mounting dogs is selectively longitudinally positionable along said retainer plate for securing a strike plate to the retainer plate at a selected longitudinal position. The mounting dogs further include laterally movable T-nuts mounted therein to allow selective lateral positioning of a strike plate. Thus, a strike plate can be mounted at any desired vertical position on the retainer plate and adjusted laterally for the "depth to stop" of a particular door before it is tightened into place. Accordingly, strike plates and deadbolt strikes are infinitely adjustable to obtain the tightest optimum closure for the active door. Readjustment, when required, is also a simple matter.

Thus, an improved swing adaptable astragal is now provided that successfully addresses the problems of the prior art. The astragal has no handed components and is thus fully adaptable either to right hand or left hand swing inactive doors. The flush bolt assembly is formed as a monolithic unit and has a single exceptionally long steel bolt about which is overmolded retainer guides, guide plates, and a locking mechanism. Thus, not only are there no components to wear out, the length and monolithic structure of the flush bolt assembly acts to spread forces on the flush bolt during an attempted forced entry along a substantial length of the astragal, greatly increasing the strength and break-in resistance of the flush bolt. Improved head and sill seals are also provided as is an improved strike plate and deadbolt strike mounting assembly. These and other features, objects, and advantages of the invention will become more apparent upon review of the detailed description set forth below when taken in conjunction with the accompanying drawings, which are briefly described as follows.

DETAILED DESCRIPTION OF THE PREFERRED EMBODIMENTS

Figure 1:
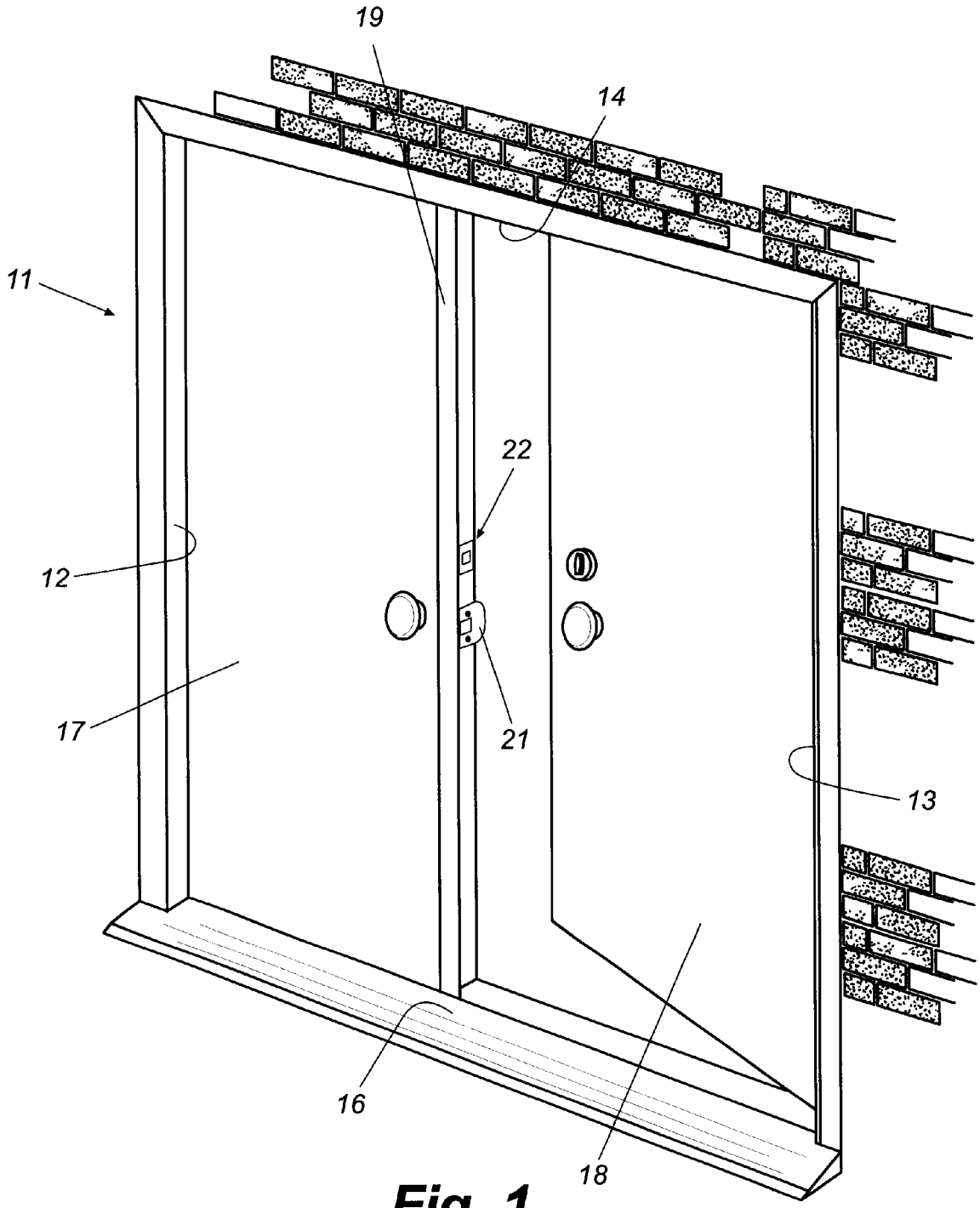
FIG. 1 is a perspective illustration of a double door entryway showing major components thereof.

Referring now in more detail to the drawings, in which like numerals refer to like parts throughout the several views, FIG. 1 illustrates a typical double door entryway with an astragal. The entryway 11 includes an entryway frame or casing defined by spaced apart vertical jambs 12 and 13 and a horizontal head jamb or header 14. A threshold and sill assembly 16 spans the bottom of the jambs 12 and 13 to complete the entryway frame. A normally inactive door 17 is hingedly mounted to the left hand (as seen from the outside of the entryway) jamb 12 and a normally active door 18 is hingedly mounted to the right hand jamb 13. Of course, the normally inactive door just as well can be mounted to the right hand jamb with the normally active door mounted to the left-hand jamb. An astragal 19 is mounted to and extends along the vertical inside edge of the normally inactive door 17. The astragal 19, which historically is made of wood but that can be made of metal or other materials, has a generally T-shaped cross section and provides a vertically extending stop against which the active door 18 can close. Flush bolts (not visible in FIG. 1) usually are slidably disposed at the top and bottom of the astragal and are extendable into the head jamb 14 and the threshold and sill assembly 16 to secure the normally inactive door 17 in its closed position. In this way, the normally inactive door, which is opened only occasionally, is secured in its closed position to provide a solid stop for the normally active door and to provide security against a would-be thief. A strike plate 21 and a deadbolt strike 22 are mounted to the inside edge of the astragal 19 and are aligned to receive the bolt and deadbolt of the normally active door when closed in the usual way. Weather stripping (not visible) typically is provided along the stop provided by the astragal 19 to seal against drafts and blown rainwater when the normally active door is closed against the stop.

Figure 2:
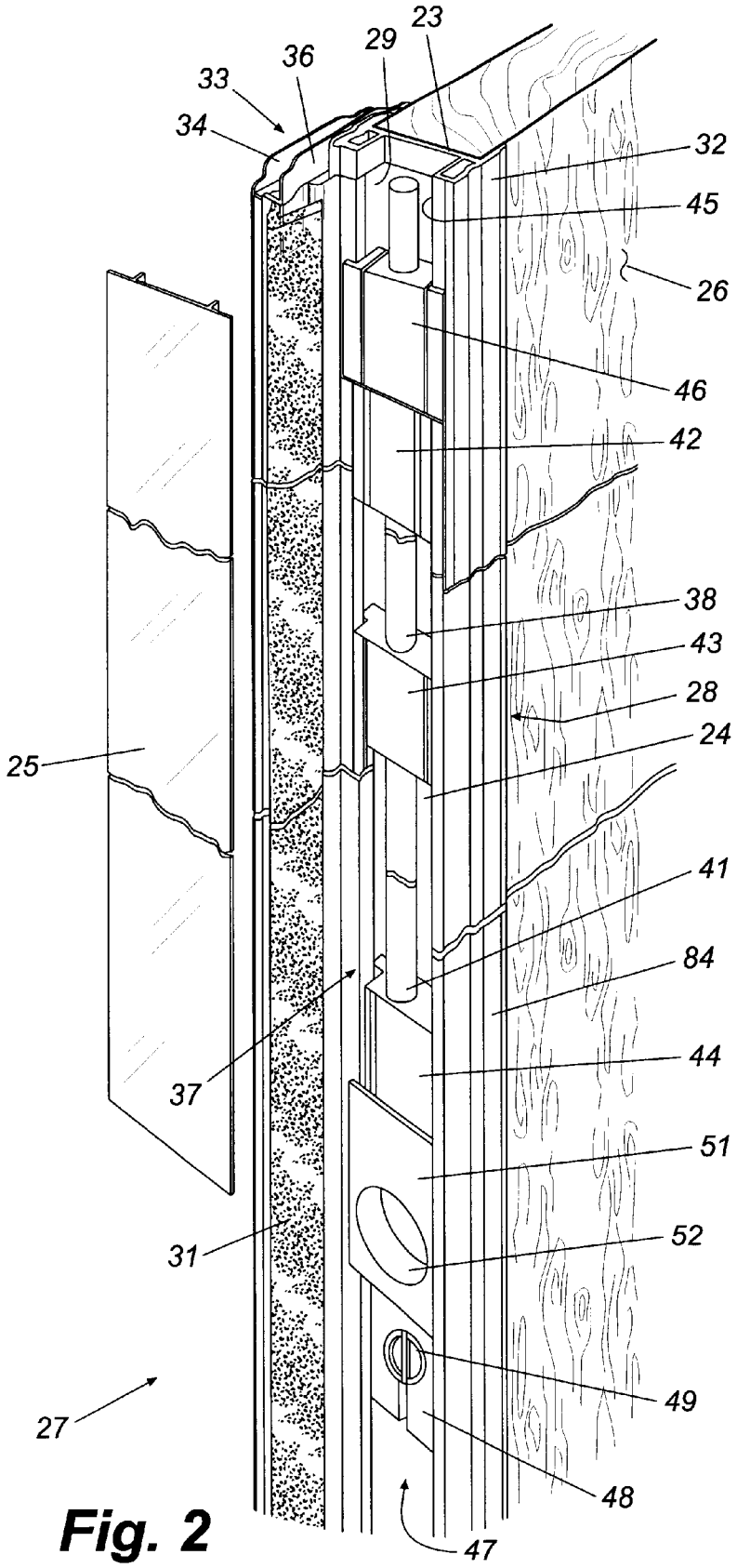
FIG. 2 is a perspective partially exploded view of the upper portion of an astragal and flush bolt assembly that embody principles of the present invention in a preferred form.

FIG. 2 is a perspective partially exploded view of the upper portion of an astragal assembly that embodies principles of the present invention in one preferred form. The astragal assembly 27 includes a frame 28, which preferably is made of extruded aluminum. The frame 28 can be made of other materials such as plastic or steel if desired, but aluminum is preferred because of its strength, lightweight, and ease of extrusion. The frame 28 is shown mounted to and extending along the vertical inside edge of the normally inactive door 26 of a double door entryway. In this regard, screws extending through screw holes 24 and into the edge of the door securely attach the frame 28 to the door.

The frame 28 is extruded to have a generally T-shaped profile with a relatively wide outside molding 83 (visible in FIG. 7) and a relatively narrow inside molding 84. The outside and inside moldings preferably are contoured to resemble the decorative milled shape of traditional wooden astragals, but this certainly is not a requirement of the invention. A web 45 extends between and joins the outside and inside moldings.

A recess 23 is defined along the inactive side of the frame 28 and this recess is sized and shaped to receive the inside vertical edge of the inactive door 26. As mentioned above, screw holes 24 are formed in and are judicially positioned along the web 23 for securing the frame 28 and thus the astragal assembly to the vertical inside edge of the inactive door 26 with screws. More specifically, the screw holes are staggered along the length of the web, rather than being aligned. This configuration provides secure attachment of the frame across its entire width to the door edge.

The extruded frame 28 is further contoured to define a pair of spaced elongated channels 29 (only one of which is visible in FIG. 1), which extend along the length of the frame. The channels 29 are shaped to receive the various working components of the astragal assembly 27 as further detailed hereinbelow.

An elongated flush bolt assembly 37 is slidably disposed within the frame 28 and is selectively movable in a vertical direction toward and away from the upper end of the frame 28. In the preferred embodiment, an identical flush bolt assembly (not visible in FIG. 1) is slidably disposed in the frame 28 adjacent the bottom end thereof and it is movable in a vertical direction toward and away from the bottom end of the frame. It will be understood that the description herein of the upper flush bolt assembly shown in FIG. 1 and of its operation is equally applicable to the lower flush bolt assembly. In fact, the symmetry of the flush bolt assembly and its components is one of the novel features of the invention because it renders the entire astragal assembly non-handed; that is, the same astragal assembly can be mounted on a normally inactive door that is either a left hand swing or a right hand swing door. The manufacture and stocking of separate left and right hand astragal assemblies and components therefore is not required.

The flush bolt assembly 37 includes an elongated rod or bolt 38, which preferably is formed of steel or hardened steel, but that may be formed of another suitable material such as graphite or reinforced fiberglass if desired. The bolt 38 has a first or upper end 39 and a second or lower end 41 and is substantially longer than the bolts of traditional prior art flush bolt assemblies. In a preferred embodiment, the length of the bolt 38 is about 26 inches, although other lengths are possible depending on the size and construction of the entryway.

An upper retainer guide 42 and guide block 46 are formed about the bolt 38 adjacent its upper end 39, which protrudes from the guide block 46 a relatively short distance. The upper retainer guide 42 and guide block 46 are unitarily injection molded directly onto the bolt 38 in an overmolding process that results in a composite structure that is substantially monolithic and extremely strong and resilient. The portion of the bolt 38 within the overmolded retainer guide and guide block preferably is knurled or otherwise configured to assure adhesion and to eliminate any movement of the overmolded structures about the bolt. The upper retainer guide 42 and guide block 46 preferably are molded as a single unit and are made of a strong resilient plastic material such as, for example, ABS or ASA plastic. Other suitable materials obviously may be selected if desired.

The upper retainer guide 42 is configured to be received and slidably secured within the channels 29 formed by the extruded frame 28. More specifically, the upper retainer guide 42 is formed with spaced apart wings or projections 30 (FIG. 14*a*) that fit and ride within the channels 29 to help secure the flush bolt assembly 37 to the frame while allowing it to slide vertically therein. The guide block 46 is formed to nestle and ride between the channels 29 and to provide lateral support to the protruding first end 39 of the bolt 38.

A middle retainer guide 43 is injection overmolded onto the bolt 38 at a position intermediate its first and second ends 39 and 41 respectively. The middle retainer guide 43 preferably is formed of the same resilient plastic material as the upper retainer guide 42 and also is injection overmolded onto a knurled section of the bolt 38 to form a strong monolithic structure. The middle retainer guide 43 has a configuration that is the same as that of upper retainer guide 42. Thus, the middle retainer guide 43 also is secured and rides within the channels 29 formed in the extruded frame 28 of the assembly. As discussed in more detail below, the middle retainer guide 43 supports and secures the mid-portion of the bolt 38 within the frame 28 and also helps to spread and distribute lateral forces applied to the first end 39 of the bolt during high winds or an attempted forced entry.

A lower retainer guide 44 is injection overmolded onto the second or lower end 41 of the bolt and functions to secure this end of the bolt slidably within the channels 29 formed in the frame 28. As with the upper and middle retainer guides, the lower retainer guide 44 preferably is formed of resilient plastic material and is configured with protrusions sized to fit and ride within the channels 29 to secure the lower end of the flush bolt assembly 37 slidably within the frame 28.

A thumb latch 51 and a locking mechanism 47 are injection molded with and as extensions of the lower guide block 44. The thumb latch 51 has a configuration similar to that of the guide block 46 and rides between the channels 29 of the frame to provide lateral support to the lower end portion of the flush bolt assembly. A circular indentation 52 is molded into the thumb latch 51 and is sized to receive a thumb or finger for sliding the flush bolt assembly up and down in the frame 28. The locking mechanism 47 includes a locking plug retainer 48 into which is mounted a rotatable locking plug 49.

Figure 3:
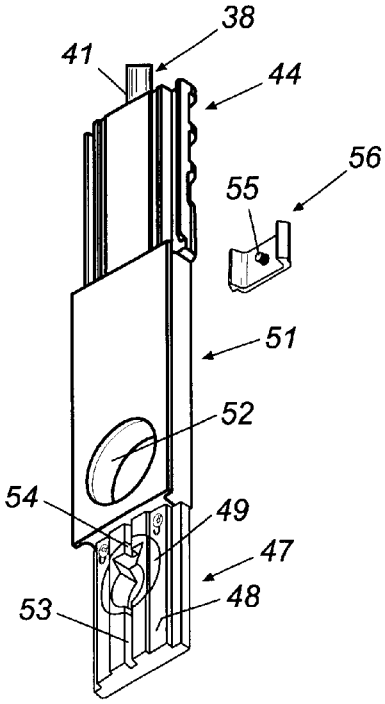
FIG. 3 is a perspective view of the interior end portion of a flush bolt assembly according to the invention showing the integrally molded retainer guide, thumb latch, locking mechanism, and friction plate thereof.
Figure 4:
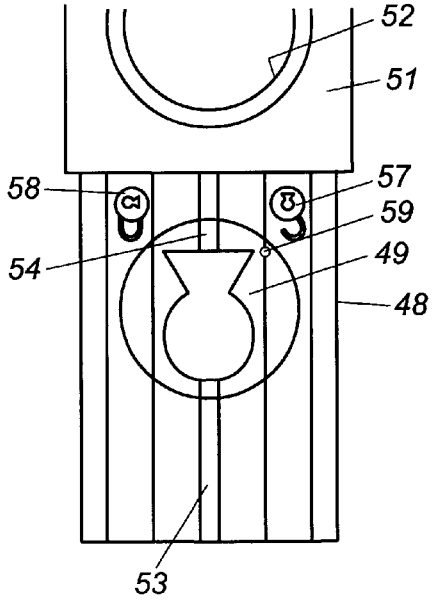
FIG. 4 is a front elevational view of the locking mechanism of the flush bolt assembly.
Figure 5:
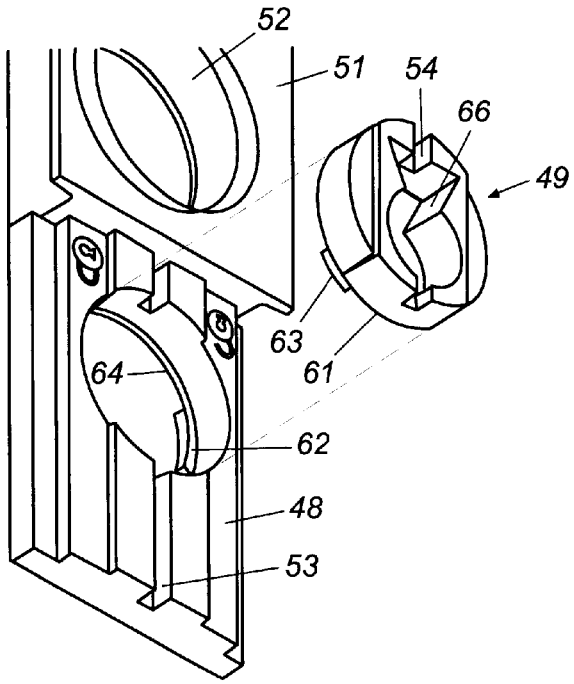
FIG. 5 is a perspective exploded view of the locking plug and locking plug retainer.

The lower retainer guide 44, thumb latch 51, and locking mechanism 47 are more clearly illustrated in FIGS. 3 through 5 and their use and function are described in more detail below relative to these figures. However, it will be appreciated from the forgoing description that the flush bolt assembly 37 is slidably disposed within the frame 28 and may be selectively moved between a unsecured position as shown in FIG. 2, wherein the protruding end 39 of the bolt 38 is retracted into the frame, and a secured position (FIG. 13) wherein the protruding end 39 of the bolt projects beyond the upper end of the frame for extension into the head jamb of an entryway to secure the inactive door 26 in its closed position.

The upper end of the extruded aluminum frame 28 is capped by an end plug 32. The end plug 32, which preferably is formed of an appropriate plastic material, is carefully configured so that it can be inserted into either end of the extruded frame 28 to accommodate both left hand and right hand installations of the astragal assembly. In this regard, the end cap is configured to be bilaterally symmetrical to accommodate insertion in either end of the frame.

A head seal 33, also plastic, is secured to the upper end of the frame 28. A similar head seal may also be secured to the bottom end of the frame if desired. The head seal 33 is formed to define a cover plate 34 and an upstanding sealing tab 36. As detailed below, the cover plate 34 covers and seals the otherwise open top end of the outside molding 83 to prevent moisture from seeping inside the molding. The sealing tab 36, which preferably is somewhat flexible, engages the stop or the weather stripping of the head jamb of a double door entryway when the inactive door is closed and provides additional support or gives body to the weather-strip. The tab 36 thus provides a seal against drafts and windblown rain that otherwise might pass between the head jamb and the top end of the astragal assembly. Accordingly, the head seal provides a dual function and seals at a location where prior art astragal assemblies traditionally can leak.

The frame 28 is shaped to receive and secure a length of weather stripping 31 against which the normally active door of a double door entryway rests when closed. The weather stripping seals along the inside edge of the active door and thus seals the junction between the active and inactive doors against drafts and blown rain in the usual way. Finally, a decorative flush bolt cover plate 25 is adapted to be snapped onto the flush bolt to cover and hide the flush bolt assembly 37 within the frame and to provide a pleasing aesthetic appearance to the inside edge of the astragal assembly.

FIGS. 3 through 6 illustrate the structure of the unique locking mechanism that forms an integral part of the flush bolt assembly of this invention. The lower guide block 44 is shown overmolded onto the second end 41 of the elongated metal bolt 38 as described above. Thumb latch 51 with its circular recess 52 extends downwardly from the lower guide block and is integrally molded therewith. The locking mechanism 47, which includes locking plug retainer 48 and locking plug 49, extends downwardly from the thumb latch 51 and the locking plug retainer 48 is integrally molded therewith. Thus, the lower retainer guide 44, thumb latch 51, and locking plug retainer 48 are all molded together as a single unitary piece and are all injection overmolded onto the end of the bolt 38.

The locking mechanism is made up of a locking plug retainer 48, which is configured to ride within and between the channels 29 formed in the extruded frame 28 of the astragal assembly. A locking plug 49 is selectively rotatably mounted within an annular opening formed in the locking plug retainer. More specifically, and as best illustrated in FIG. 5, the locking plug 49 is generally disc-shaped and sized to be received in the annular opening formed in the locking plug retainer. The inside edge of the locking plug is formed with an annular recess or undercut rim 61 and an opposed pair of radially extending tabs or tangs 63 (only one of which is visible in FIG. 5) project from the bottom of the locking plug. The annular opening in the locking plug retainer is formed with an undercut lip 64, which extends around the inside peripheral edge of the opening. Opposed inwardly projecting tabs 62 (one of which being visible in FIG. 5) extend radially inwardly from opposed sides of the undercut lip 64. With this configuration, it will be seen that the locking plug 49 can be snapped into place by pressing it into the opening formed in the locking plug retainer 48.

When snapped into place, the tangs 63 of the locking plug nestle and ride within the undercut lip 64 while the inwardly projecting tabs 62 nestle and ride within the undercut rim 61 formed around the locking plug. The tangs 63 and tabs 62 are sized and positioned to allow the locking plug 49 to be rotated within the opening of the locking plug retainer through a predetermined angle between two extreme positions. A keyhole 66, which can take on any of a number of shapes, is formed in the locking plug to accommodate rotation of the locking plug within the locking plug retainer with a finger, a coin, a key, or any suitable object inserted into the keyhole.

The locking plug retainer has side edges configured to ride under the channels 29 formed in the frame 28 to secure the retainer slidably in place. A central slot 53 is molded into the locking plug retainer and a similarly sized central slot 54 is molded into the locking plug. When the locking plug is rotated to one of its extreme positions as shown in FIG. 3, referred to as its unlocked position, the slots 53 and 54 align with each other to form a continuous slot extending the length of the locking plug retainer. When the locking plug is rotated to its other extreme position, its locked position, the slots 53 and 54 misalign with each other. In this locked position, the locking plug effectively blocks the slot formed in the locking plug retainer.

Figure 15:
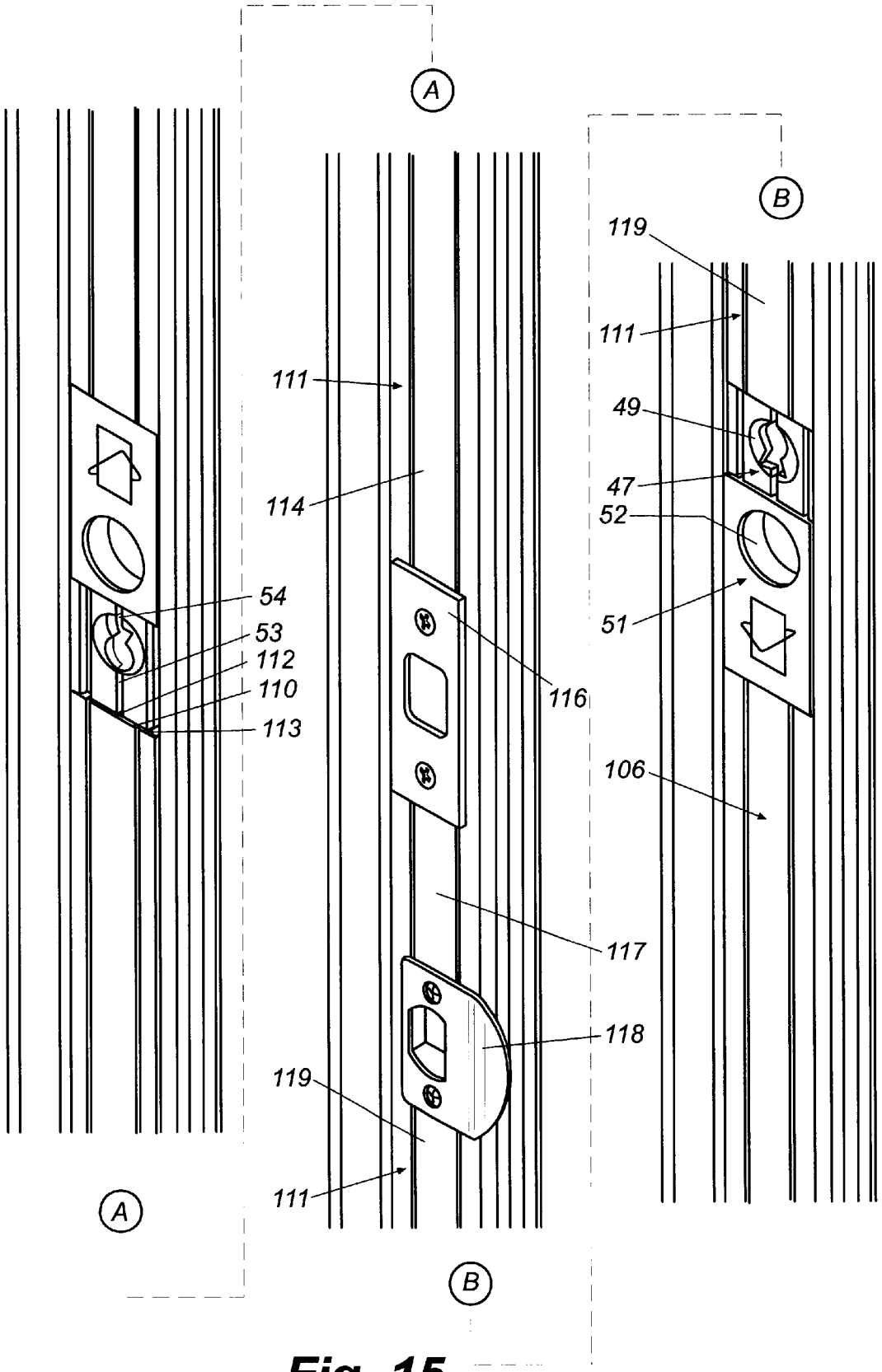
FIG. 15 is a continuous perspective view of a portion of an assembled astragal assembly of this invention showing the upper flush bolt locking mechanism, the strike plate retainer assembly, and the lower flush bolt locking mechanism.

The function of the locking mechanism 47 perhaps is best illustrated in FIG. 15. A retainer plate cover 114 is mounted to the frame of the astragal assembly in the middle portion thereof and has one end positioned adjacent to the locking mechanism 47. A central rib 112 projects inwardly from the retainer plate cover and is positioned to align with the slot 53 formed in the locking plug retainer. When the locking plug is in its unlocked position, the entire flush bolt assembly is free to slide downwardly within the frame because the aligned slots of the locking plug retainer and locking plug slide over the inwardly projecting central rib 112 of the retainer plate cover 114. However, when the locking plug is in its locked position blocking the slot 53, the rib 112 engages the locking plug upon slight downward movement of the flush bolt assembly. The flush bolt assembly is thus locked in its upwardly extended position, wherein the end 39 of the bolt extends into the head jamb to lock the inactive door securely in its closed position.

The same thing happens at the bottom end of the astragal assembly, which is substantially a mirror image of the top end. Thus, both the top and bottom of the inactive door can be locked in its closed and secured condition by extending the upper and lower flush bolt assemblies to their secured positions and rotating their respective locking plugs to their locked positions. Indicia 57, 58, and 59 are printed on or molded into the components of the locking mechanism to indicate clearly when the locking plug is in its locked and its unlocked position respectively.

Figure 6:
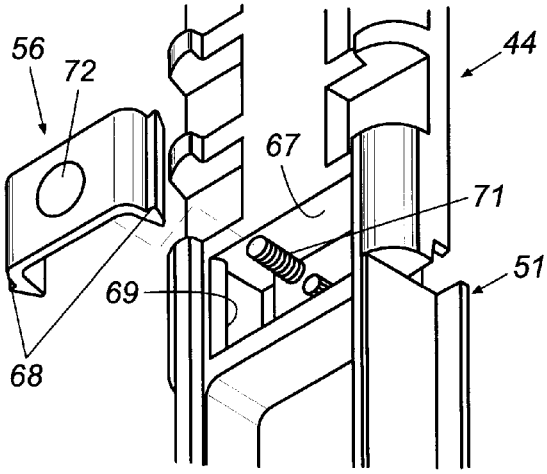
FIG. 6 is a perspective exploded view of the friction plate and spring assembly according to one aspect of the invention.

FIG. 6 illustrates a spring biased friction plate 56 mounted in the back side of the lower retainer guide 44 for providing some resistance to sliding movement of the flush bolt assembly within the frame 28. The amount of resistance is predetermined to be low enough to allow the flush bolt assembly to be slid manually with relative ease between its locked and unlocked positions while at the same time high enough to prevent the assembly from sliding in the frame under its own weight. Thus, the assembly can be slid up or down to its secured or its unsecured position, where it is held by friction provided by the friction plate. Although FIG. 6 illustrates a preferred configuration of the friction plate, it will be understood that other configurations are possible and are within the scope of the invention.

The friction plate 56 is generally U-shaped and is formed with a pair of opposed projecting latches 68 on its two legs. A rectangular recess 67 is formed in the backside of the lower retainer guide 44 and is sized to receive the friction plate 56. Inwardly projecting latch keepers 69 are formed along the short sides of the recess 67 and are positioned to engage the latches 68 of the friction plate when the friction plate is disposed within the recess. In this way, the friction plate 68 is held within its recess but is free to move in and out with respect thereto. A coil spring 71 is mounted on a tab formed in the floor of the recess and is received at its other end on a corresponding tab (not visible in FIG. 6) formed on the back of the friction plate. The spring 71 is sized to bias the friction plate to its outward most position within the recess 67, while allowing the friction plate to be depressed against the bias of the spring into the recess. More than one spring may be employed if desired.

A protrusion 72 is formed on the face of the friction plate. When the flush bolt assembly is disposed within the frame as shown in FIG. 2, the protrusion 72 of the friction plate 56 is biased by the spring 71 into frictional engagement with the web 45 of the T-shaped frame. The spring constant of the spring 71 is selected to provide sufficient friction between the protrusion and the web to prevent the flush bolt assembly from sliding within the frame under its own weight while at the same time allowing it to be slid relatively easily by a user between its locked and unlocked positions.

Figure 7:
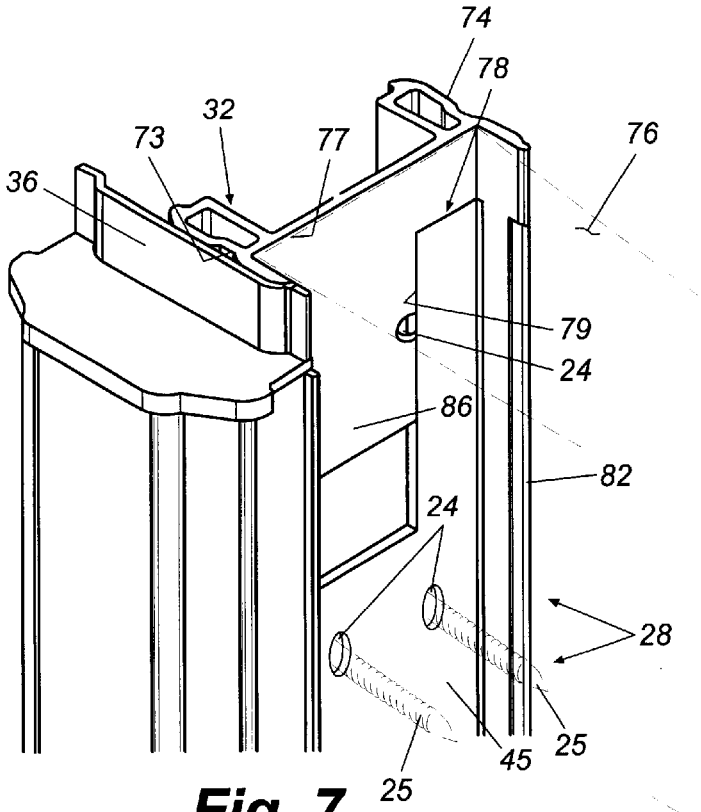
FIG. 7 is a perspective view of the top portion of the astragal of this invention mounted on a left hand swing door and illustrating the reversible end plug and head seal mounted thereon.
Figure 8:
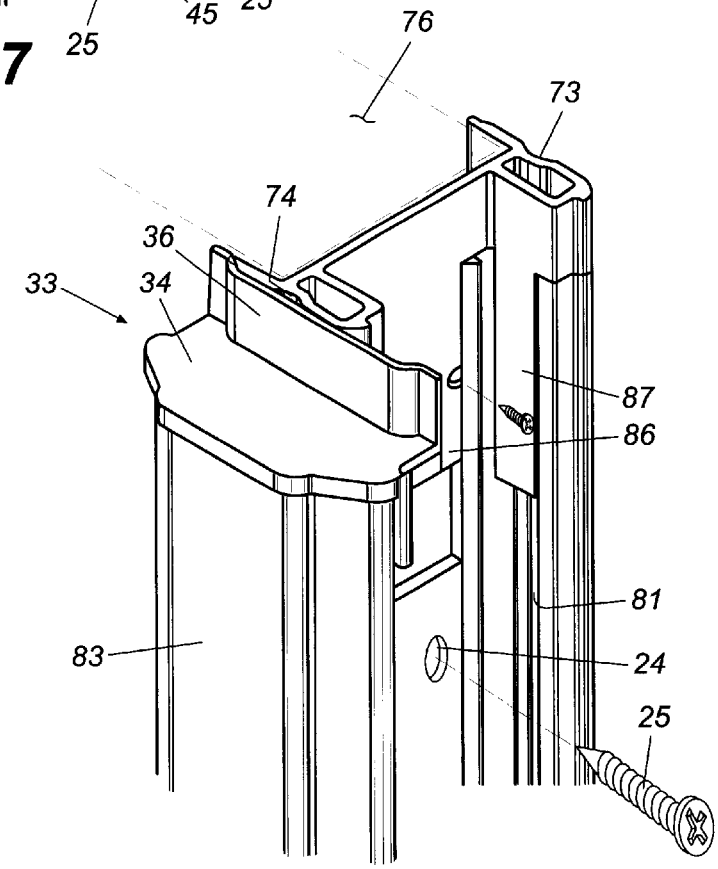
FIG. 8 is a perspective view of the top portion of the astragal of this invention mounted on a right hand swing door and illustrating the reversible end plug and head seal mounted thereon.

FIGS. 7 and 8 illustrate the upper end portion of the astragal assembly of this invention and specifically show some of the unique components that render the astragal assembly usable with either a right hand or a left hand swing inactive door. FIG. 7 shows the upper end portion of the astragal assembly mounted to the vertical inside edge of a right hand (as seen from the outside) swing normally inactive door and FIG. 8 illustrates the upper end portion of the assembly mounted to a left hand swing inactive door. It will be understood in the descriptions of these figures that each end of the extruded aluminum frame of the assembly is a mirror image of the other end, which makes the frame non-handed. The components shown in FIGS. 7 and 8, which also are non-handed, adapt whichever end of the frame is the upper end in a particular installation for mating with and closing against the head jamb of an entryway. Of course, the other end of the frame in each case is adapted to cooperate with the threshold and sill assembly of the entryway, as discussed in more detail below.

Referring to FIG. 7, the generally T-shaped extruded aluminum frame 28 is shown with its outside molding 83 and its inside molding 82 joined by web 45. The top end 78 of the frame is cut off square and a rectangular slot 79 is cut and extends a predetermined distance into the web 45. The purpose of the rectangular slot 79 is to accommodate the sealing block (FIGS. 21–23) when the end is disposed at the bottom end of a door in an oppositely handed installation This sealing block and its function are described in more detail below. The frame 28 is secured to the vertical inside edge 77 of a left-hand swing door 76 by means of screws 25 that extend through screw holes 24 formed in the web of the frame and into the door. In practice, the screw holes 24 are judiciously positioned in the web so that screws may be inserted and tightened without removing the flush bolt assembly from the frame.

An end plug 32, which preferably is made of plastic but that may be made of aluminum or another material, is positioned in the end portion of the frame 28. The end plug 32 has a downwardly projecting tab 86 sized to fit and extend at least partially into the slot 79 cut into the web of the frame 28. The end plug 32 extends upwardly from the end of the frame 28 a short distance corresponding to or just less than the thickness of the stop formed in the head jamb and to a position level with the top edge of the door 76.

The astragal assembly is mounted to the door 76 such that the top edge of the door is coextensive with the top edge of the end plug, as shown. Screw holes 24 are formed in the end plug for receiving small screws that extend into the vertical inside edge 77 of the door to secure the end plug firmly in place atop the frame 28. The end plug 32 is formed with ears 73 and 74, which are mirror images of each other. Each ear has an outside face that is contoured to match the contour of the inside molding 82 of the frame. Thus, the outside face of the ear 74 in FIG. 7 is coextensive with and forms a short extension of the inner molding 82 of the frame. Further, the end plug is bilaterally symmetrical. Accordingly, when inserted in the other end of the frame to accommodate an oppositely hung door as shown in FIG. 8, the face of the other ear 73 becomes coextensive with and is an upward extension of the inner molding 82. Both left and right hand swing inactive doors are therefore accommodated without special handed components.

A head seal 33 is secured to the top end of the frame 28. The head seal, which preferably is formed of a relatively softer pliable plastic such as EPDM or flexible PVC, has a cover plate 34 from which an upstanding flexible sealing tab 36 upwardly extends. The purpose of the head seal 33 is at least two-fold. First, the cover plate 34 covers and seals the open top end of the outer molding 83 of the frame 28. This prevents the migration of moisture and debris into the hollow portion of the outer molding. Second, the upstanding flexible sealing tab 36 engages and seals against the stop of the head jamb or against the weather stripping attached thereto when the normally inactive door is closed. Where weather stripping is present, the sealing tab also provides support and body to the weather stripping. This forms a seal against drafts and windblown rain along the head jamb spanning the critical junction between the upper inside corners of the inactive and active doors, which historically has been a common location for leakage. As with the end plug 32, the cover plate 34 is bilaterally symmetrical so that the same end plug design can be used both on a right hand swing inactive door (FIG. 7) and a left-hand swing inactive door (FIG. 8). In addition, a head seal also may be provided on the bottom of the astragal covering and sealing the lower end of the outer molding.

It will be appreciated from the forgoing description that the end plug 32 and head seal 33 of this invention may be used to adapt either end of the frame 28 to be the top end of an astragal assembly. Thus, both left and right handed installations are accommodated with the same components. Furthermore, the head seal 33 provides a unique advantage over prior art astragal configurations because it provides a reliable seal against drafts and moisture at the historically leaky junction of the upper inside corners of the doors of a double door entryway.

Figure 9:
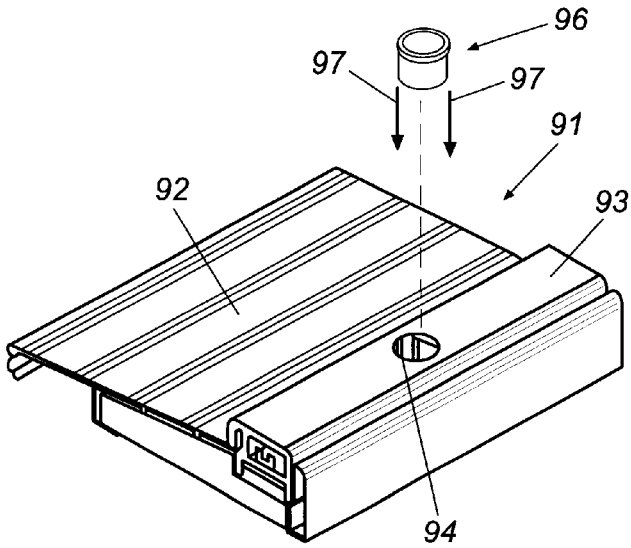
FIG. 9 is a perspective partially exploded view illustrating insertion of a flush bolt retainer plug embodying principles of the invention into a predrilled hole in a door sill.
Figure 10:
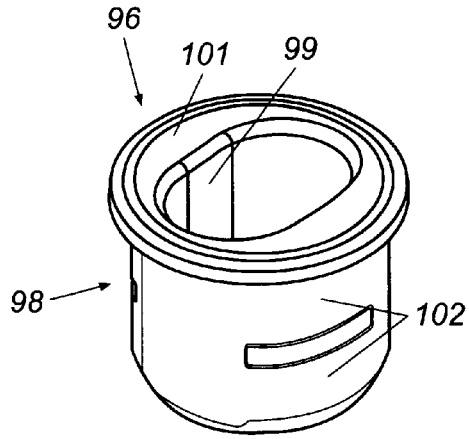
FIG. 10 is a perspective view of a flush bolt retainer plug that embodies principles of the invention in a preferred form.
Figure 11:
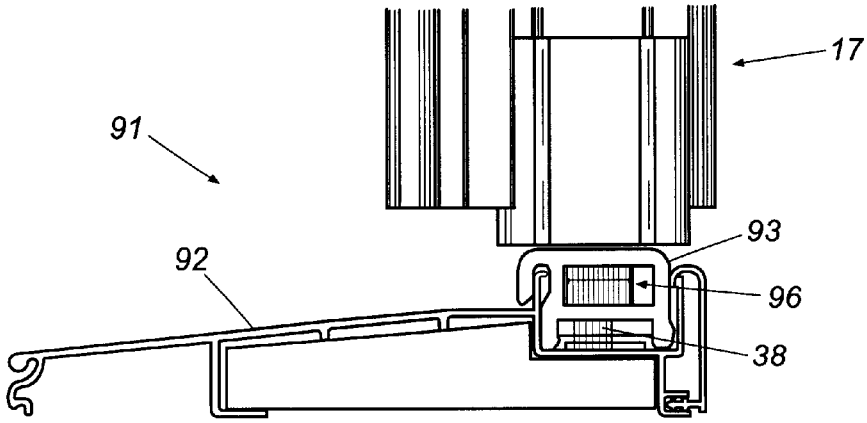
FIG. 11 is an end elevational view of a lower flush bolt extending into the flush bolt retainer plug of FIG. 10 mounted in a sill to secure an inactive door in place.

With the astragal assembly of the present invention, the normally inactive door of a double door entryway is secured by sliding the upper flush bolt assembly upward so that the end of its bolt extends into the head jamb, and by sliding the lower flush bolt assembly downward so that the end of its bolt extends into the threshold cap of the threshold and sill assembly. FIGS. 9, 10, and 11 illustrate a unique method of creating openings in the sill and the head jamb for receiving the ends of the flush bolts.

FIG. 9 illustrates the central portion of a common threshold and sill assembly 91 having a sloping sill 92 and a threshold cap 93 positioned to underlie the closed doors of the entryway. The threshold and sill assembly 91 illustrated in FIG. 9 is a traditional extruded aluminum sill with an extruded plastic threshold cap. The invention may also be applied to other types of sills such as, for example, sills with traditional wooden threshold caps.

A hole 94 is formed in the threshold cap with the hole being centered on the location where the end of the lower flush bolt enters the threshold cap when in its secured position. A flush bolt retainer plug 96 is inserted into and fixed within the hole 94 as indicated by arrows 97. As shown in FIG. 10, the flush bolt retainer plug 96, which preferably is made of a hard resilient plastic material, has a generally cylindrical body 98 with an outer diameter corresponding to or slightly larger than the diameter of the hole 94 formed in the threshold cap 93. An oblong or eccentric opening 99 is formed in the flush bolt retainer plug and the plug is formed with a radially outwardly projecting rim 101 extending around the top of its body 98. Longitudinally extending ribs 102, preferably but not necessarily, extend from the top to the bottom of the plug.

In use, the flush bolt retainer plug 95 is pressed into the hole 94 in the threshold cap, where it is secured by a friction fit with the walls of the hole 94. The plug is oriented in the hole such that the long axis of its eccentric opening 99 extends along the direction of the threshold cap. The external annular groove may be positioned to help hold the flush bolt retainer plug in position within the hole. As illustrated in FIG. 11, when an inactive door provided with the astragal assembly of this invention is closed and its lower flush bolt assembly slid to its lowered secured position, the bottom end of the bolt 38 extends into the opening of the flush bolt retainer plug to secure the bottom end of the inactive door in place.

Since the opening 99 in the retainer plug is eccentric in the direction of the threshold cap, any movement of the inactive door in this direction due, for example, to expansion and contraction, settlement, or manual adjustment of the swing of the door is accommodated by the flush bolt retainer plug. In addition, adjustments to the margins of the door, if required, are also accommodated. However, since the opening in the retainer plug is not eccentric in a direction transverse to the threshold cap, the door is always secured in the proper position overlying the threshold cap. In this way, a secure properly positioned stop is provided for the closing of the normally active door. A further feature of the plug is its ease and simplicity of installation compared to prior techniques, which generally have required that metal plates be attached with screws to the surfaces of the seal and head jamb. A more pleasing appearance is also provided.

Figure 12:
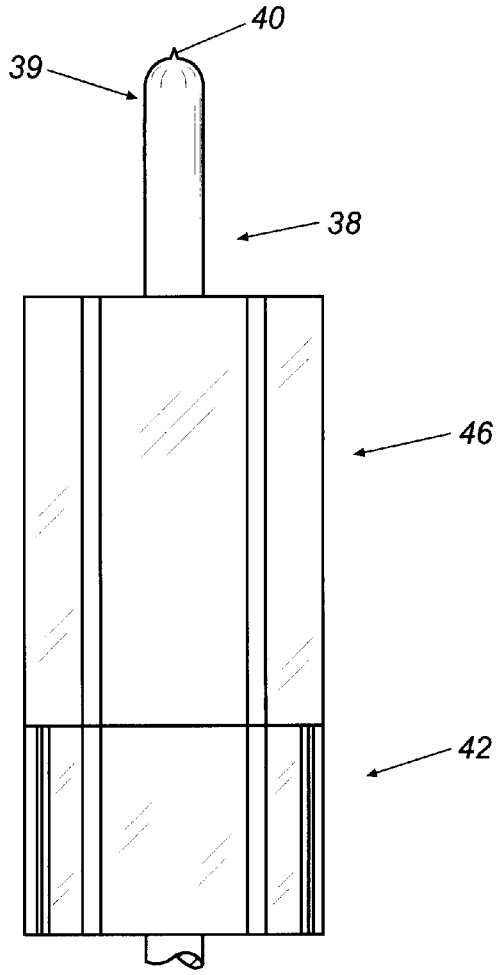
FIG. 12 is a side elevational view of the operative end of the flush bolt assembly illustrating the marking nib formed on the end of the bolt for marking the location of the flush bolt retainer plug.

FIG. 12 illustrates another aspect of the present invention related to the flush bolt retainer plug. The upper end of a flush bolt assembly of the invention is shown with the end 39 of the bolt 38 projecting from the guide block 46 and retainer guide 42. A sharpened nib 40 is formed on the extreme end of the bolt and is centered with respect thereto. The nib is used when hanging a normally inactive door provided with the astragal assembly of this invention to locate the precise position to drill a hole for accepting a flush bolt retainer plug. Specifically, when the door is hung on its hinges and properly plumbed and adjusted for swing, it is closed to its proper closing position. The upper and lower flush bolt assemblies are then slid firmly toward their secured positions until the nibs on the ends of the their bolts engage and mark the head jamb at the top of the door and the threshold cap at the bottom of the door. Holes are then drilled in the head jamb and the threshold cap at the locations of the markings and flush bolt retainer plugs are pressed into the holes. In this way, the flush bolt retainer plugs are automatically and precisely positioned to receive the flush bolts of the inactive door without tedious and error prone measuring required in the past.

Figure 13:
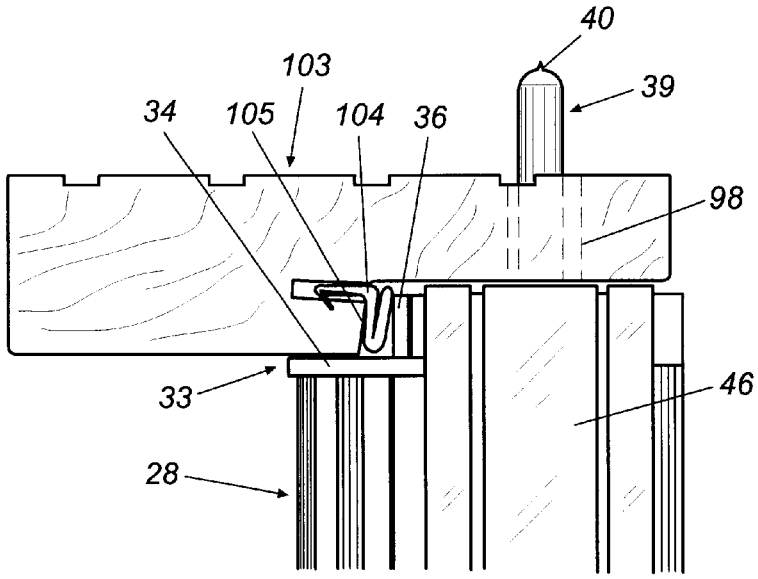
FIG. 13 is a side elevational view illustrating extension of the top flush bolt into a flush bolt retainer plug pressed into the head jamb of an entryway.

FIG. 13 illustrates the interaction of the astragal assembly of the present invention with the head jamb of a double door entryway to secure the inactive door in place. The head jamb 103 is milled to define a stop 105 that carries a weather strip 104. A flush bolt retainer plug 98 is shown pressed into a hole formed in the head jamb as previously described. The upper flush bolt assembly in this figure is shown in its secured position with the end 39 of the bolt extending into the flush bolt retainer plug to secure the inactive door in place within the entryway.

The head seal 33 also is shown in FIG. 13 attached to and covering the top of the outer molding 28. The flexible sealing tab 36 of the head sill is seen engaging and sealing against the weather strip 104 carried by the stop of the head jamb. In this way, a seal is created that extends unbroken across the upper adjacent corners of the active and inactive doors when the doors are closed. In FIG. 13, the cover plate 25 (FIG. 2) is removed to reveal the guide block 46 at the top portion of upper flush bolt assembly. It will be understood, however, that in use, the guide block 46 generally is covered by the cover plate 25 to block debris and present a pleasing aesthetic appearance.

Figure 14A:
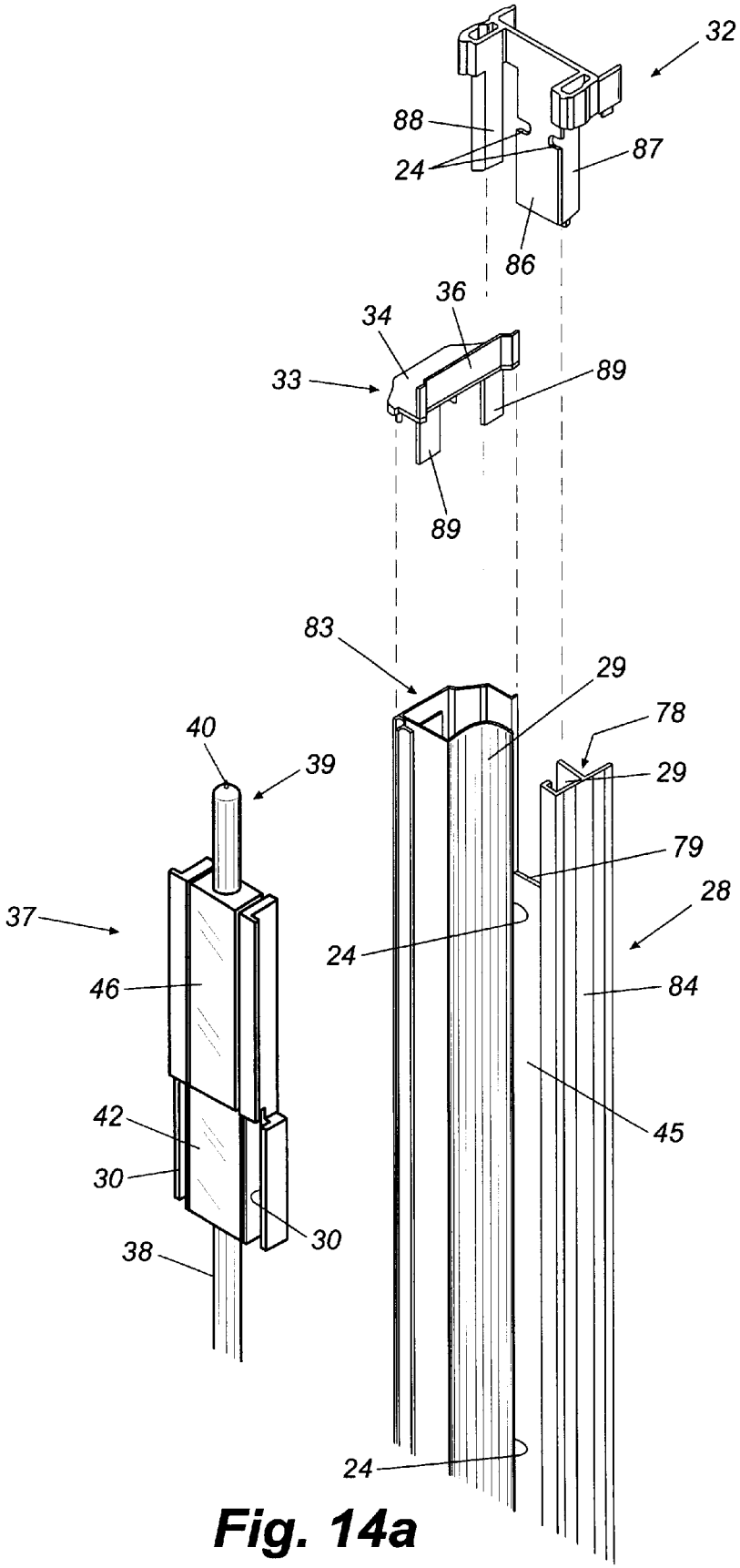
FIGS. 14*a* and 14*b* are continuous exploded perspective views showing the astragal frame, flush bolt assembly, end plug, head seal, and flush bolt cover plate of the invention.

FIG. 14*a* illustrates in a perspective exploded view the top portion of the astragal assembly of the present invention, including the various components thereof, and illustrates a preferred method of mounting the end plug 32 and head seal 33 to the top of the astragal frame 28. The extruded aluminum frame 28 is illustrated with its outside molding 83, its inside molding 84, and the interconnecting web 45. The frame 28 is profiled to define spaced apart channels 29 that extend the length of the frame and that receive and slidably secure the flush bolt assembly as described above. More specifically, the flush bolt assembly 37 includes an elongated steel bolt 38 having an upper end 39 formed with a marking nib 40. Guide block 46 and upper retainer guide 42 are seen to be integrally overmolded onto the bolt 38 with the upper end of the bolt projecting upwardly from the guide block 46. The upper retainer guide 42 is formed with projections 30, which fit and slide within the channels 29 of the frame as previously described to allow the flush bolt assembly to be slid longitudinally in the frame 28. In practice, the flush bolt assembly 37 is installed in the frame by sliding it into the channels 29 from the top of the frame.

The end plug 32, which is inserted into and slightly extends the top end 78 of the frame, includes a depending tab 86 and a pair of spaced apart depending tongues 87 and 88. As discussed above, the end plug 32 is bilaterally symmetrical so that it can be inserted into either end of the frame to form the top portion thereof depending upon whether the astragal assembly is to be installed on a left or right hand swing door. The depending tongues 87 and 88 of the end plug 32 are sized and positioned to be pressed into the ends of the channels 29 to hold the end plug snuggly and securely in place on the top of the frame. Holes 24 also are formed in the depending tab 86 of the end plug for receiving small screws that are driven into the edge of a door to secure the end plug more firmly in place. As discussed, the purpose of the end plug 32 is to extend the upper portion of the astragal frame slightly to the height of the inactive door to which it is attached so that the top of the assembly rests behind the stop of a head jamb when the door is closed.

The head seal 33 with its cover plate 34 and flexible upstanding sealing tab 36 is formed with depending tongues 89, which also are sized and positioned to be pressed into the end of the frame such that the head seal covers the open top of the outside molding 83. As previously mentioned, holes 24 are formed at spaced intervals along the web 45 of the frame for attaching the frame securely to the vertical inside edge of a door. These holes are staggered and positioned such that they are not covered by the flush bolt assembly and are thus accessible to attach the astragal assembly to a door without removing the flush bolt assembly.

Figure 14B:
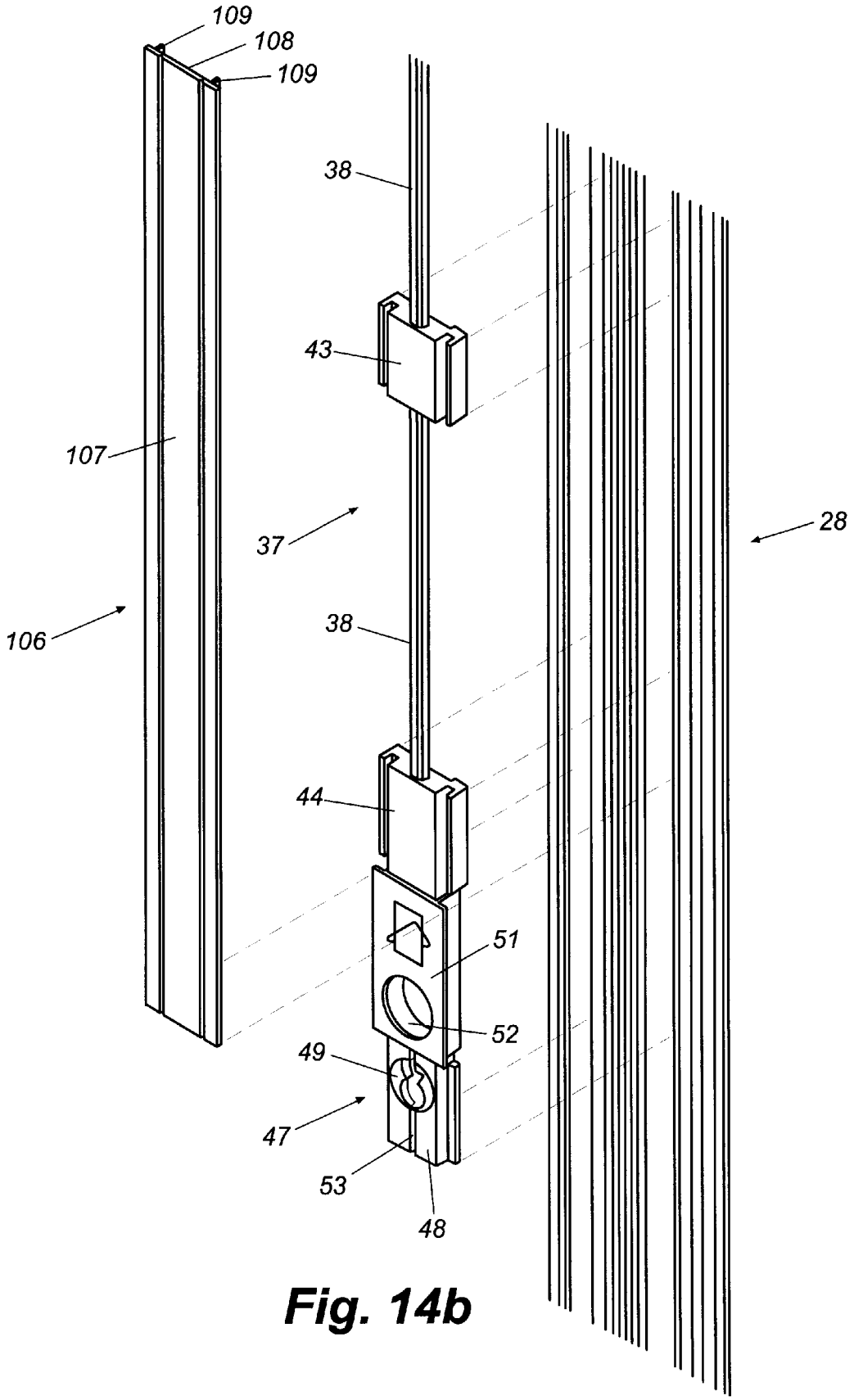

FIG. 14*b* is a downward continuation of FIG. 14*a* and illustrates additional components of the astragal assembly of the invention. The continuation of the frame 28 is shown as is the continuation of the flush bolt assembly 37. The middle retainer guide 43 is shown injection overmolded onto the elongated metal bolt 38 in the mid-section thereof for securing and guiding the mid-section of the bolt 38 within the channels 29 of the frame. Lower retainer guide 44, thumb latch 51, and locking mechanism 47 are shown overmolded onto the lower end of the bolt 88 as described above. Thumb latch 51 has opening 52 for insertion of a finger to slide the flush bolt assembly up and down and the locking mechanism includes locking plug retainer 48, rotatable locking plug 49, and central slot 53.

Flush bolt cover 106 has a decorative outside face 107 and is configured to snap into place substantially covering and enclosing the flush bolt assembly 37 within the frame. When snapped in place, the flush bolt cover 106 rides up and down with the flush bolt. Thus, the bottom end of the thumb latch serves as a stop to limit and define the lowermost extent of travel of the flush bolt assembly within the frame and the top end of the flush bolt cover in conjunction with the top end of the retainer guide 46 limits the uppermost extent of travel. Specifically, when the flush bolt is installed in the frame and the flush bolt cover attached, the top edge of the flush bolt cover and the upper end of the guide block as (FIG. 14*a*) engage the head jamb when the flush bolt assembly is moved upwardly to its secured position. This condition is best seen in FIG. 15. The top edge of the retainer plate cover 114 (FIG. 15) limits the downward movement of the flush bolt assembly within the frame by engaging the thumb latch. It will thus be seen that the flush bolt assembly may be selectively moved within the frame between its uppermost or secured position and its lowermost or unsecured position and the range of this movement is limited by the top edge of the retainer plate cover 114 and the head jamb.

FIG. 15 illustrates a long section of the central or mid portion of the astragal assembly of this invention as it appears when fully assembled. FIG. 15 is presented in the form of three portions of the assembly that, when joined A to A, and B to B, form a continuous view. The first or left most portion begins at a position just above the bottom of the upper flush bolt cover 107, the second or middle portion shows the strike plate and deadbolt strike attached to the astragal, and the third or right most portion extends downwardly to a position below the top edge of the lower flush bolt cover 106.

Referring sequentially to the first, second, and third portions of FIG. 15, the upper flush bolt cover 107 is seen attached to the frame 28 covering the upper flush bolt assembly, which is disposed in the frame. The retainer plate 111 (best illustrated in FIG. 16), which preferably also is made of extruded aluminum, is mounted to the frame 28 in the mid section thereof and has an upper edge 110 that defines a stop against which the bottom edge of the thumb latch 51 engages when the upper flush bolt assembly is slid downwardly to its unsecured position. The retainer plate 111 is formed with an inwardly projecting central rib 112, which is judicially positioned to ride in the central slot 53 formed in the locking plug retainer 47. The rotatable locking plug also has a central slot 54 that is aligned and coextensive with the slot 53 when the plug is rotated to its unlocked position as shown in FIG. 15. The slot 54 is misaligned with the slot 53 when the locking plug 49 is rotated to its locked position.

With the just described configuration, the flush bolt assembly can be easily and quickly locked in its secured position. More specifically, when the locking plug is rotated to its unlocked position so that its slot 54 aligns with the slot 53, then the inwardly projecting rib 112 is free to ride completely through the aligned slots until the bottom edge of the thumb latch engages the top edge of the retainer plate. In this position, the upper end of the bolt 38 is retracted from the head jamb and the door is unsecured. However, when the locking plug is rotated to its locked position, wherein the slots 54 and 53 are misaligned, the slot 53 is blocked by the locking plug and the flush bolt assembly can only move down slightly until the inwardly projecting rib engages the locking plug. Thus, the flush bolt assembly is locked in its secured position with the top of the bolt extending into the head jamb of the entryway.

The advantages of this locking system are many. First, unlike prior art locking mechanisms, the locking mechanism of this invention is simple and has extremely few moving parts. Further, in many prior art systems, a locking arm must be pivoted out of the astragal and rotated between locked and unlocked positions for operation. The locking mechanism of the present invention remains flush within the astragal. Finally, the flush bolts of the present invention are easily locked in their secured positions simply by rotating the locking plug with a finger, a coin, or other appropriate object. The result is enhanced security since, when locked in their secured positions, the flush bolts cannot be jimmied by a would-be thief with a knife blade to unlock them, as is the case with some prior art flush bolts.

The second portion of FIG. 15 illustrates the mid section of the astragal assembly with a strike plate and a deadbolt strike attached thereto. The aluminum retainer plate 111 is shown attached to the frame and a decorative retainer plate cover is shown snapped into the retainer plate (see FIG. 16). A deadbolt strike 116 is secured to the astragal and is laterally and longitudinally adjustable therein as described below so that the deadbolt strike can be aligned precisely with the deadbolt of the normally active door. A strike plate 118 is secured to the astragal below the deadbolt strike and also is adjustable laterally and longitudinally as described below for alignment with the bolt of the normally active door. A spacer cover 117 is cut to fit between the deadbolt strike and strike plate to cover the space there between, and a lower retainer plate cover 119 extends from the bottom of the strike plate 118 to the bottom edge of the retainer plate 111.

The third portion of FIG. 15 is a mirror image of the first portion and shows the lower flush bolt cover 106 covering the lower flush bolt assembly of the astragal. As with the upper assembly, the bottom edge of the lower flush bolt cover and the bottom of the lower guide block form a stop to define the lower most extent of travel of the lower flush bolt assembly and the bottom edge of the retainer plate 111 forms a stop that defines the upper most extent of travel. As with the upper flush bolt assembly, the inwardly projecting central rib of the retainer plate travels in the slot of the locking plug retainer and the locking plug 49 can be rotated within the locking plug retainer to lock the lower flush bolt assembly in its secured position. It will thus be seen that the upper and lower flush bolt assemblies function in the same way to secure the upper and lower edges of the inactive door when the door is not in use.

Figure 16:
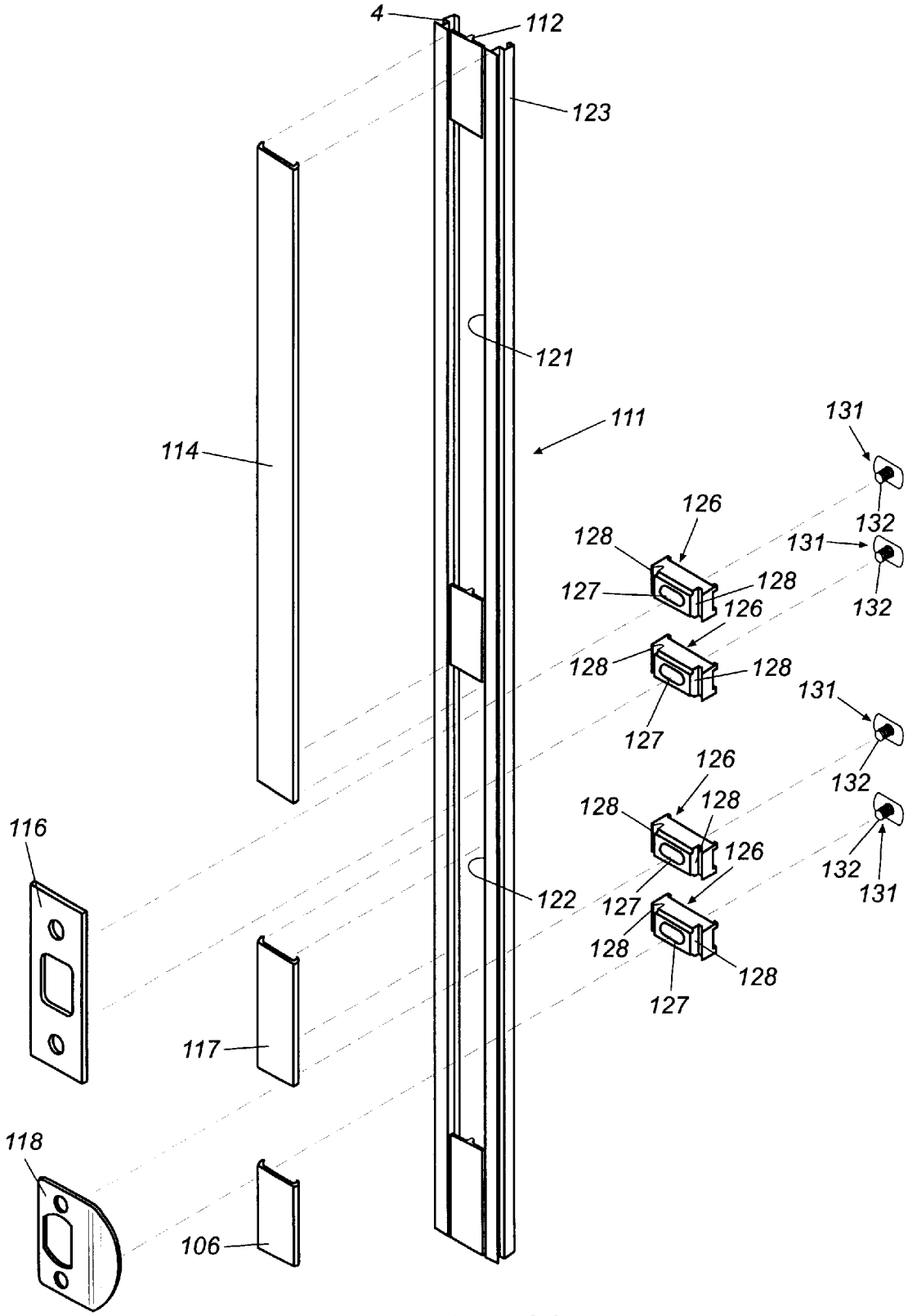
FIG. 16 is an exploded perspective view of a strike plate retainer assembly that embodies principles of the invention in a preferred form.

FIG. 16 illustrates one preferred configuration of the strike retainer plate and shows the mounting of the deadbolt strike and strike plate thereto. The extruded aluminum retainer plate 111 is shown with its inwardly projecting central rib 112. The retainer plate has a pair of relatively wide slots 121 cut therein. Decorative covers 114, and 106 and spacer cover 117 have tabs that snap within the spaced slots formed along the retainer plate so that the covers can be snapped into place covering the slots 121 and 122 of the retainer plate. The retainer plate 111 is formed with spaced, longitudinally extending, inwardly projecting legs 123 and 124, which are shaped to be received in and interlock with the channels 29 (FIG. 24) of the astragal frame 28. Thus, the retainer plate 111 is installed on the frame by being slid into the channels 29 from one end of the frame to its centrally located position. The interlocked frame and retainer plate form a combination structural geometry for the astragal that is extremely strong and resistant to bending and lateral sheering forces. More specifically, the frame and retainer plate together form a tubular rectangular structure that is similar in functional aspects to a rectangular metal beam. This geometry results in a high structural integrity and strength that far surpass that of the frame alone. In addition, the strike plate screws, when installed, engage the web of the frame, thereby enhancing strength further and preventing the retainer plate from sliding within the astragal frame.

A set of mounting dogs 126, which preferably are formed of a resilient plastic, are each formed with an eccentric bore 127 and ends 128 configured to fit and slide longitudinally within or behind the channels 29 formed in the frame of the astragal assembly. A T-nut is adapted to be snapped into each of the mounting dogs 126 and each T-nut has a threaded barrel that extends partially through and is movable along the eccentric bore of its mounting dog. Thus, the T-nuts can move within their mounting dogs laterally with respect to the retainer plate 111 and each mounting dog can move longitudinally with respect to the retainer plate by sliding within the frame of the astragal assembly.

To mount the deadbolt strike and strike plate to the astragal assembly, the retainer plate and mounting dogs are slid onto the frame of the assembly and screws (not shown) are extended through the strike plates, through the wide slot in the retainer plate, and into the threaded T-nuts of the mounting dogs. The screws are then tightened loosely to draw the deadbolt strike and strike plate against the retainer plate. The deadbolt strike and strike plate can then be moved both longitudinally and laterally until each is precisely positioned relative to the bolts of the active door, which will extend into the strike plates. When each strike plate is adjusted longitudinally, its mounting dogs slide up and down within the frame to accommodate the adjustment. During lateral adjustment, the T-nuts slide within their mounting dogs to accommodate the adjustment. It will be appreciated that the mounting dogs 126 provide at least three beneficial functions. First, they accommodate different center-to-center latch bores on doors; second, they accommodate different center-to-center screw hole distances on strikes; and third, they allow for lateral adjustment to tighten or loosen a door.

When the deadbolt strike and strike plate are properly adjusted, their screws are tightened to secure them firmly in place on the astragal assembly. The retainer covers 106 and 114 and the spacer cover 117, which preferably are made of extruded plastic, can then be cut to the proper size and snapped into place on either side of and between the strike plates. In the event that future adjustment is required because, for example, of settlement, the screws need only be loosened, the deadbolt strike and strike plates adjusted to their new positions, and the screws re-tightened. The infinite adjustability of the deadbolt strike and strike plate allows for precise alignment and adjustment of the plates to insure solid and secure closure of the active door against the astragal, which results in a more secure entryway and a better seal between the normally inactive and normally active doors.

Figure 17:
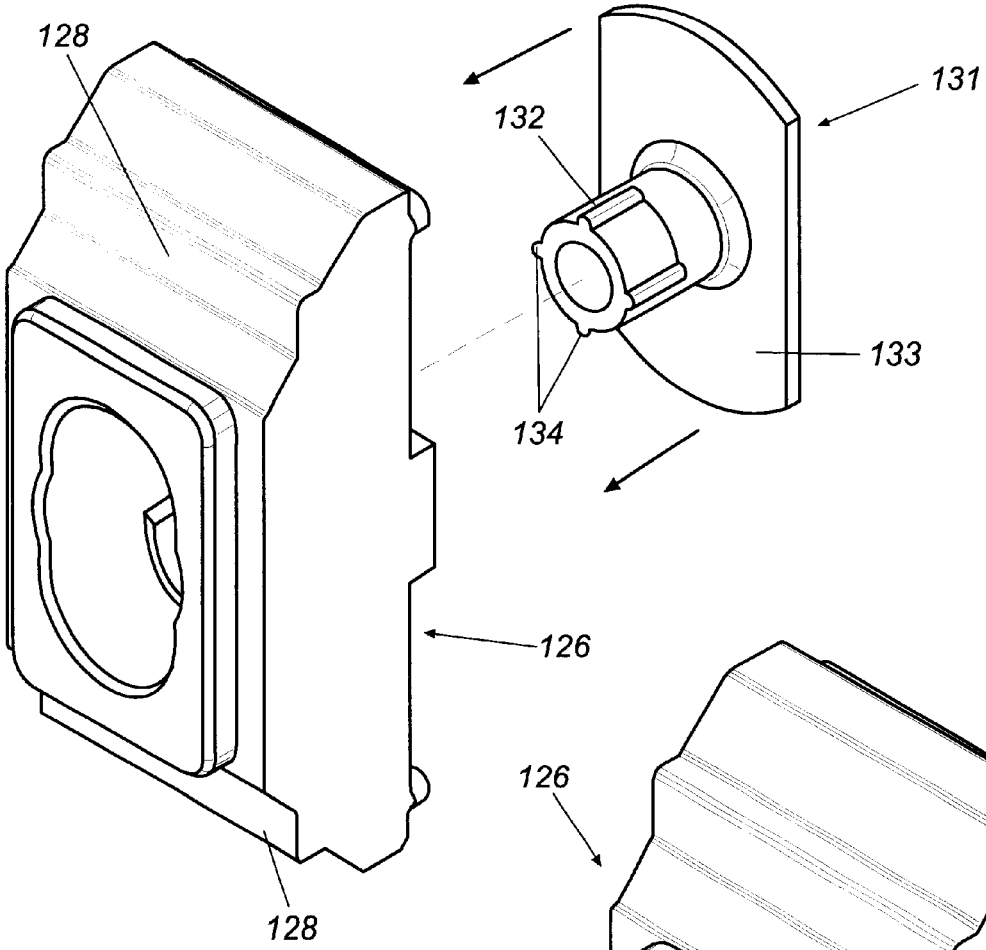
FIGS. 17–20 are perspective view of the mounting dogs that form a part of the strike plate retainer assembly of this invention.

FIGS. 17 through 20 illustrate in more detail the construction and function of the mounting dogs 126 and T-nuts 131. FIG. 17 illustrates the T-nut 131 disengaged from the mounting dog with arrows indicating the direction of movement of the T-nut to snap it into place within the mounting dog. The mounting dog 126 has ends 128 and an eccentric bore 127 as described. A ledge or hook area 129 is formed within the eccentric openings. The T-nut 131 has a threaded barrel 132 that extends from a relatively flat base 133. Skives 134 project radially outwardly from the barrel 132. In the preferred embodiment, the mounting dog is made of resilient molded plastic and the T-nut is made of zinc, although this certainly is not a requirement of the invention.

Figure 18:
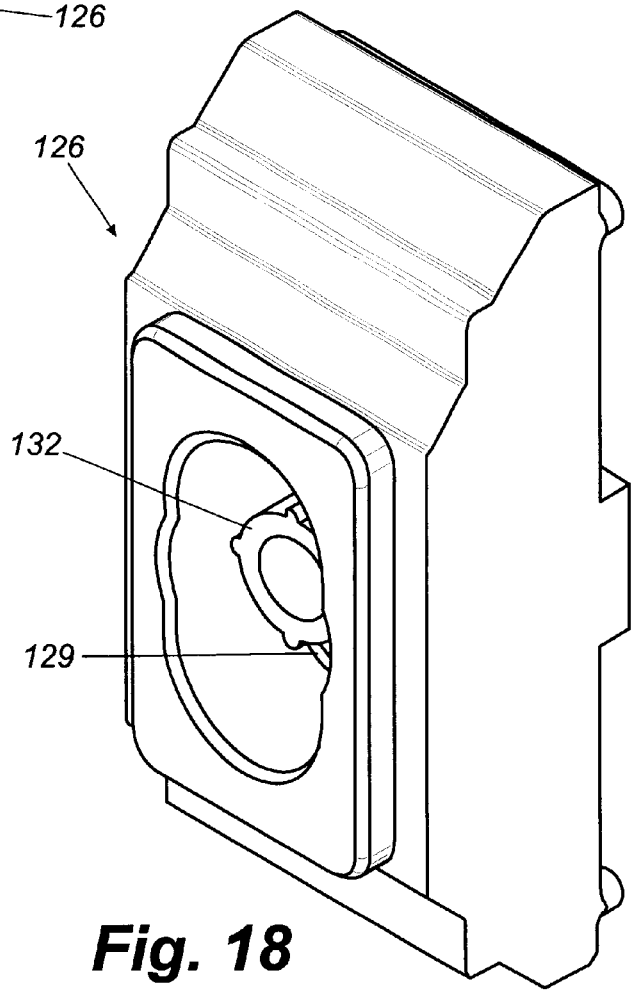

To install the T-nut in its mounting dog, the T-nut is simply forced into the mounting dog from the back. The eccentric bore in the mounting dog expands just slightly to allow the skives 134 to pass beyond the hook areas 129, whereupon the bore returns to its normal size. Thus, the skives of the T-nut become captured by the hook areas 129 so that the T-nut is secured within the mounting dog. The position of the hook areas and skives is predetermined to allow the T-nut to slide with relative ease within the mounting dog so that the treaded barrel is movable along the length of the eccentric bore to accommodate lateral adjustment of a strike plate as previously described. FIG. 18 illustrates the appearance of the mounting dog as it appears with its T-nut snapped in place for use.

Figure 19:
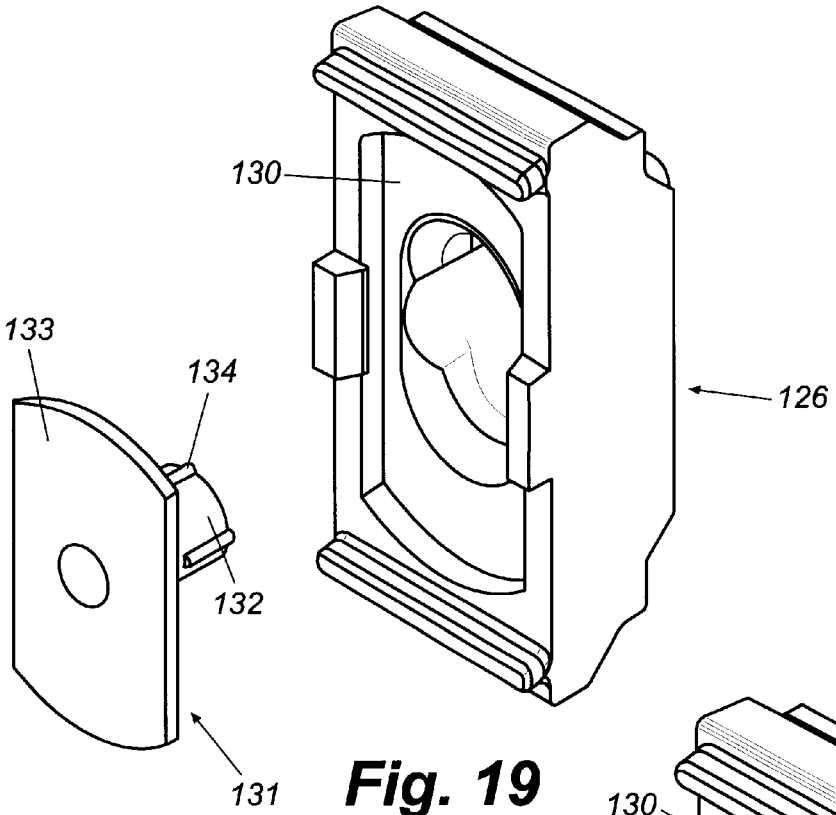
Figure 20:
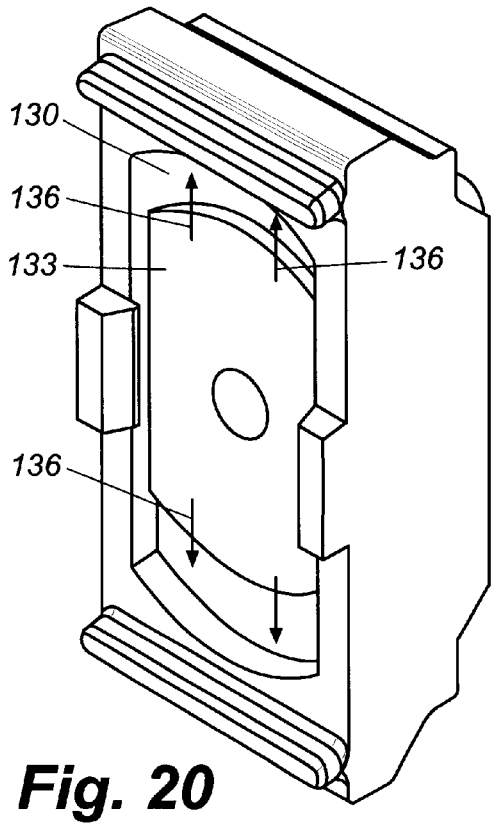

FIGS. 19 and 20 are rear views of the mounting dog assemblies shown in FIGS. 17 and 18 respectively. In FIG. 19, the mounting dog 126 is formed with a recess 130 in its rear surface and the recess is slightly larger than the base 133 of the T-nut 131. In this way, when the T-nut is snapped into place within the mounting dog as shown in FIG. 20, the base 133 slides within the recess 130 as indicated by arrows 136. This allows lateral adjustment of a strike plate as previously described and also functions to secure the T-nut against rotational movement so that the advancing of screws into the T-nut will not cause the T-nut to rotate within its mounting dog.

Figure 21:
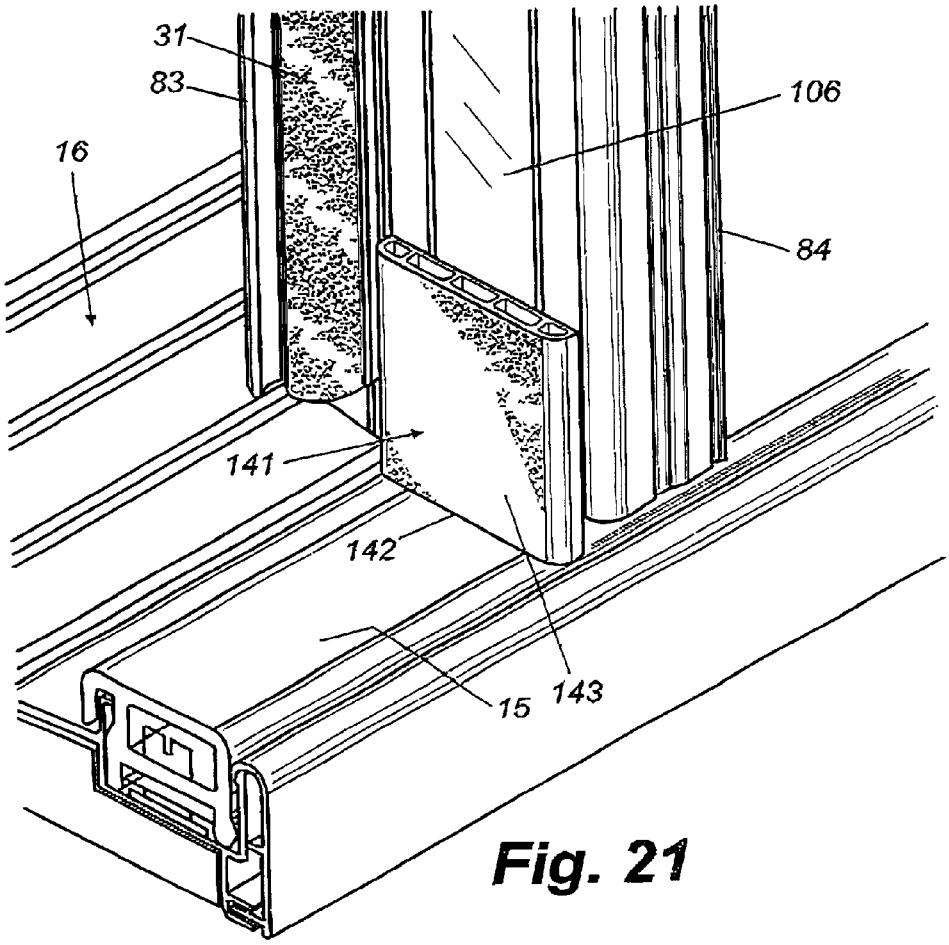
FIG. 21 is a perspective view of the lower portion of an astragal assembly according to this invention showing the integral sealing block mounted thereto.
Figure 22:
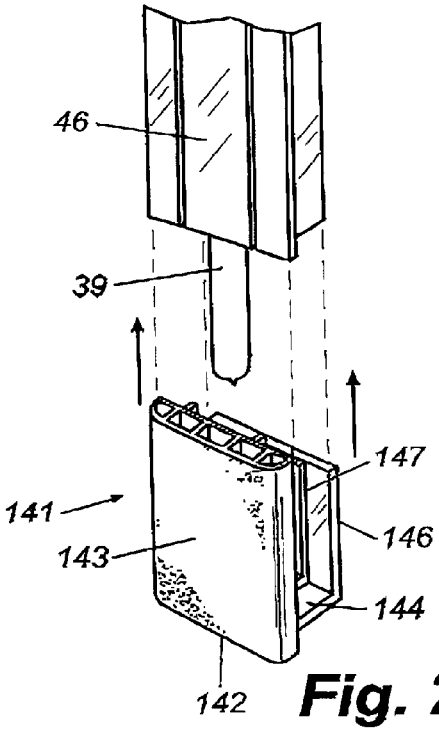
FIG. 22 is a perspective exploded view illustrating placement of the integral sealing block on the guide plate of the lower flush bolt assembly.
Figure 23:
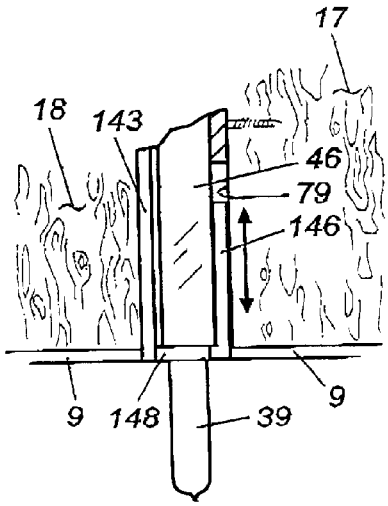
FIG. 23 is a side elevational view of the sealing block mounted to the flush bolt assembly illustrating the creation of a seal beneath the astragal assembly.

FIGS. 21 through 23 illustrate another inventive aspect of the astragal assembly of this invention in the form of an integral bottom-sealing block. One location where drafts and leakage can occur in double door entryways is at the sill where the bottom inside corners of the two doors meet or, in other words, between the bottom end of the astragal and the threshold cap. The purpose of the bottom-sealing block is to seal this area when the inactive door is secured and the active door closed to prevent such drafts and leakage.

FIG. 21 shows the bottom inside corner of a normally inactive door to which an astragal assembly according to the present invention is attached. The bottom-sealing block 141, which preferably is made of relatively soft plastic or rubberized material, is shown with its outside face 143 facing the bottom inside corner of the active door of the entryway, when the active door is closed. The thickness of this portion of the bottom sealing block is selected to be slightly larger than the space between the inside edges of the active and inactive doors when shut so that the outside face 143 of the sealing block engages and is compressed against the bottom inside corner of the active door when it is shut against the inactive door. The bottom-sealing block 141 has a bottom side 142, which engages and seals against the top of the threshold cap 15 of the entryway's sill assembly when the lower flush bolt assembly of the astragal is in its lowered secured position. Thus, a seal is created against both the edge of the active door and the top of the threshold cap.

In FIG. 22, the bottom sealing block is seen to be substantially U-shaped in longitudinal section having an outside leg 143, and inside leg 146, and a bight portion 144 joining the two. The sealing block 141 is sized to be received on and fit over the guide block 46 of the lower flush bolt assembly. In this regard, an opening 148 (FIG. 23) is formed in the bight portion of the sealing block to accommodate the protruding end portion 39 of the bolt 38. While the bottom sealing block 141 is illustrated in FIG. 22 being inserted over the guide block 46, it will be understood that the bottom sealing block may be overmolded onto the guide block during an injection molding process. In fact, overmolding is preferred because it creates a better bond between the sealing block and the guide block and eliminates an assembly step in the fabrication of the astragal assembly.

In FIG. 23, the bottom inside corners of an inactive door 17 and an active door 18 are shown in their closed positions. Rubberized sweeps 9 engage and seal between the bottoms of the doors and the threshold cap of the entryway in the traditional way. The lower flush bolt assembly of the astragal is shown (with other components of the astragal eliminated for clarity) in it lowered or secured position with the protruding end 39 of its bolt extending into the sill. It can be seen from this figure that, in this configuration, the outside face 143 of the bottom sealing block engages and seals against the bottom inside edge of the active door, the bottom edge of the sealing block engages and seals against the threshold cap, and the inside face, which extends through the rectangular slot 79 (FIG. 7) in the web of the astragal frame, engages and seals against the bottom inside edge of the inactive door. Thus, a complete and continuous seal is created from the bottom inside edge of one door, across the threshold cap, and to the bottom inside edge of the inactive door. Drafts and particularly windblown rains are therefore blocked and prevented from entering a dwelling at this critical juncture of the two doors of the entryway. When the lower flush bolt assembly is raised to its unsecured position, the bottom sealing block rises with it so that it does not interfere with the normal opening and closing of the inactive or active doors.

Figure 24:
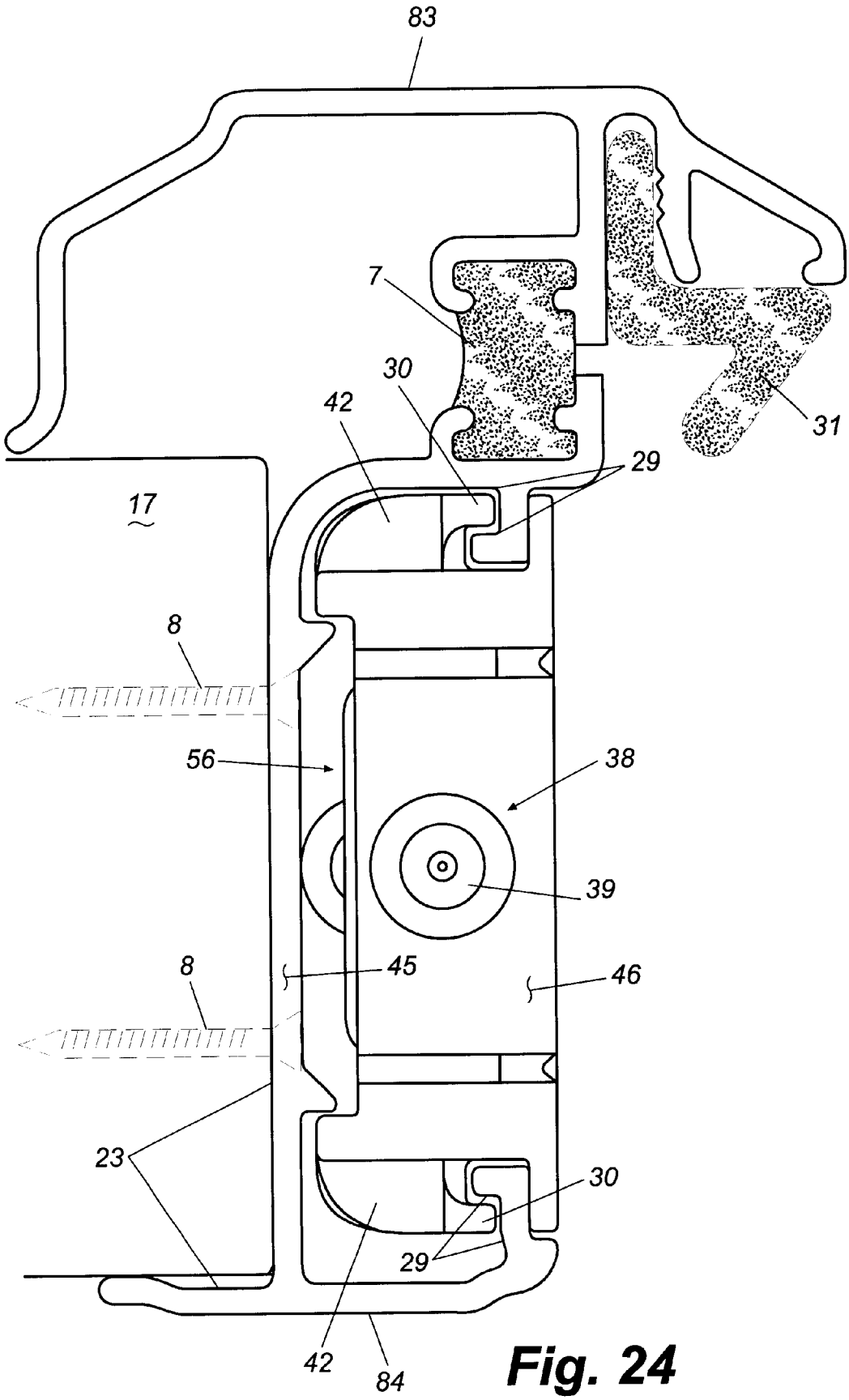
FIG. 24 is an end view of the astragal assembly of this invention showing the relationships of various components thereof.

FIG. 24 is a view from the top (or bottom) of the astragal assembly of this invention and illustrates clearly the interactions of certain components of the astragal assembly. The extruded aluminum frame 28 is shown with its inside molding 84, its outside molding 83, and interconnecting web 45. The astragal assembly is shown attached with screws 8 to the inside edge of an inactive door 17. The frame defines spaced apart channels 29 in which projections 30 of the retainer guides of the flush bolt assembly ride. A thermal break 7 can be provided if desired to prevent condensation on interior components of the astragal assembly in cold climates. Weather stripping 31 is disposed in a weather stripping slot formed in the frame for engaging and sealing against an active door when closed against the astragal assembly. The end 39 of bolt 38 protrudes from guide block 46 and friction plate 56 rides against the web 45 as described to prevent involuntary sliding of the flush bolt assembly within the frame.

The astragal assembly of this invention provides a multitude of advantages over prior art astragal assemblies. The unitary overmolded construction of the flush bolt assemblies eliminates many of the separate components previously required and greatly simplifies fabrication of the astragal assembly itself. Further, and perhaps more importantly, the exceptionally long bolts of the flush bolt assemblies in conjunction with the unitary overmolded retainer blocks spaced therealong function exceptionally well to spread or distribute lateral forces on the ends of the bolts along a substantial portion of the length of the assembly. In other words, the moment of inertia under such conditions is moved away from the end of the astragal assembly. Thus, large lateral forces created by an a t tempted forced entry or by high winds do not tend to deform the astragal frame or break or bend the bolts as is the case with prior art flush bolts. In fact, double door entryways provided with the astragal assembly of the present invention have been found to meet building codes and standards required for homes in hurricane prone areas.

The flush bolt locking mechanism of this invention also is formed as an integral part of the flush bolt assembly, which simplifies fabrication, is easy to operate, and is reliable. The unique method of mounting strike plates to the astragal assembly with the aluminum retainer plate enhances significantly the strength and resiliency of the astragal assembly because of the "I-beam" effect it has when the strike plates are securely attached with screws forming a rigid rectangular tube-shaped assembly.

Significantly, all of the components of the astragal assembly of this invention are symmetrical and reversible. This provides the very real advantage that handed components are not required. The same astragal assembly and all of its components can be configured easily as a left-hand swing or a right hand swing astragal. This not only eliminates the requirement to manufacture and stock both right and left handed parts and components, it also simplifies the entire fabrication process. Many other advantages of this invention will be obvious to those of skill in the art, including its relatively easy adaptability to a French door configuration wherein the handles of the inactive door operate the flush bolt assemblies.

The invention has been described herein in terms of preferred embodiments and methodologies. It will be obvious to those of skill in the art, however, that many changes to the illustrated embodiments are possible, all within the spirit of the invention. For example, the materials from which the various components of the assembly are made can be other than the preferred materials discussed herein, depending upon the conditions under which the astragal will be used. Also, while the configuration of the key hole in the locking plug has been shown with a particular shape, other configurations certainly are possible, For example, a simple straight slot that can receive a coin may be equally desirable. These and many other additions, deletions, and modifications may well be made by those of skill in the art without departing from the spirit and scope of the invention as set forth in the claims.

What is claimed is:

1. An astragal assembly for mounting to the vertical edge of the inactive door of a double door entryway, said astragal assembly comprising:

an elongated frame having a top end and a bottom end, said elongated frame defining a longitudinally extending channel;

a first flush bolt assembly moveably mounted in said longitudinally extending channel;

said first flush bolt assembly comprising an elongated bolt having a first end and a second end and a set of retainer guides integrally molded about said bolt at selected positions therealong, said retainer guides being slidably captured within said longitudinally extending channel for selective longitudinal movement of said first flush bolt assembly between a secured position wherein said first end of said elongated bolt protrudes from a selected end of said elongated frame for extension into the casing of an entryway to secure the inactive door in place and an unsecured position wherein said first end of said elongated bolt is retracted into said channel to free the inactive door.

2. An astragal assembly as claimed in claim 1 and wherein one of said retainer guides is disposed adjacent said first end of said bolt and includes a guide block integrally molded about said bolt, said first end of said bolt projecting from said guide block.

3. An astragal assembly as claimed in claim 2 and wherein one of said retainer guides is disposed adjacent said second end of said bolt and includes a locking mechanism integrally molded about said bolt for selectively locking said first flush bolt assembly in its secured position.

4. An astragal assembly as claimed in claim 3 and wherein said locking mechanism includes a locking plug retainer carrying a locking plug, said locking plug being selectively rotatable within said locking plug retainer between a locked position wherein said first flush bolt assembly is locked in its secured position and an unlocked position wherein said first flush bolt assembly is free to be moved to its unsecured position.

5. An astragal assembly as claimed in claim 4 and further comprising a strike retainer plate mounted to said frame at least partially covering said channel, said strike retainer plate having a first end located adjacent said locking mechanism and having a rib projecting at least partially into said channel, said locking plug and said locking plug retainer being formed with respective grooves, said grooves being aligned with each other and with said rib when said locking plug is in its unlocked position to allow said first flush bolt assembly to be moved to its unsecured position and misaligned with each other when said locking plug is in its locked position to prevent said first flush bolt assembly from being moved to its unsecured position.

6. An astragal assembly as claimed in claim 5 and wherein said locking mechanism further includes a thumb latch integrally molded about said bolt adjacent said locking plug retainer, said thumb latch being formed with a thumb hole for selective manual movement of said first flush bolt assembly between its secured and its unsecured positions.

7. An astragal assembly as claimed in claim 1 and further comprising a second flush bolt assembly movably mounted in said longitudinal channel, said second flush bolt assembly comprising an elongated bolt having a first end and a second end and a set of retainer guides integrally molded about said bolt at selected positions therealong, said retainer guides being slidably captured within said longitudinally extending channel for selective longitudinal movement of said second flush bolt assembly between a secured position wherein said first end of said elongated bolt protrudes from the other end of said elongated frame for extension into the casing of an entryway to secure the inactive door in place and an unsecured position wherein said first end of said elongated bolt is retracted into said channel to free the inactive door.

8. An astragal assembly as claimed in claim 7 and further comprising a first flush bolt cover mounted to said first flush bolt assembly at least partially covering said first flush bolt assembly.

9. An astragal assembly as claimed in claim 8 and further comprising a second flush bolt cover mounted to said second flush bolt assembly at least partially covering said second flush bolt assembly.

10. An astragal assembly as claimed in claim 1 and further comprising an end plug secured in a selected end of said elongated frame, said end plug being reversible to be inserted into left hand and right hand astragal assemblies.

11. An astragal assembly as claimed in claim 10 and further comprising a head seal mounted in at least one end of said elongated frame, said head seal covering a portion of said at least one end of said frame to prevent migration of water and debris into said frame.

12. An astragal assembly as claimed in claim 11 and wherein said head seal further comprises a panel positioned to engage the jamb of an entryway when the head seal is mounted in the top end of said elongated frame and the inactive door is closed to prevent migration of water and debris between a door casing and said top end of said frame into a building structure.

13. A flush bolt assembly for installation in the elongated frame of an astragal, said flush bolt assembly comprising an elongated bolt' having first and second ends and a set of retainer blocks integrally molded on said elongated bolt at selected positions therealong for slidably retaining said flush bolt assembly within the frame of the astragal.

14. A flush bolt assembly as claimed in claim 13 and further comprising a locking mechanism integrally molded about said bolt for selectively locking said flush bolt assembly in a secured position.

15. A flush bolt assembly as claimed in claim 14 and wherein said locking mechanism is integrally molded about said bolt at one end thereof.

16. A flush bolt assembly as claimed in claim 15 and wherein said locking mechanism comprises a locking plug retainer carrying a locking plug, said locking plug being selectively rotatable within said locking plug retainer between a locked position and an unlocked position.

17. A flush bolt assembly as claimed in claim 16 and wherein said locking plug retainer and said locking plug are formed with respective grooves and wherein said grooves are aligned with each other when said locking plug is in its locked position and misaligned with each other when said locking plug is in its unlocked position.

18. A flush bolt assembly as claimed in claim 17 and wherein said locking mechanism is integrally molded with one of said retainer guides.

19. A flush bolt assembly as claimed in claim 13 and further comprising a friction plate mounted on one of said retainer guides for bearing against an astragal in which said flush bolt assembly is mounted to hold said flush bolt assembly in a selected position within said astragal.

20. A flush bolt assembly as claimed in claim 19 and wherein said friction plate is captured within a recess formed in said one of said retainer guides and further comprising a spring disposed between said friction plate and said retainer guide within said recess for maintaining said friction plate in frictional engagement with an astragal within which said flush bolt assembly is mounted.

21. A flush bolt assembly as claimed in claim 20 and wherein said friction plate is formed with a protrusion positioned for frictional engagement with an astragal within which said flush bolt assembly is mounted.

22. An astragal assembly for mounting to the vertical edge of the inactive door of a double door entryway, said astragal assembly comprising an elongated frame defining a longitudinally extending channel, at least one flush bolt assembly slidably mounted in said frame, and a strike plate retainer mounted to said frame for receiving and securing one or more strike plates mounted to said astragal, said frame being provided with an array of mounting holes extending therealong, said mounting holes being offset relative to one another to enhance the strength of said astragal when said frame is mounted to the vertical edge of a door with screws extending through said mounting holes and into said door.

* * * * *

UNITED STATES PATENT AND TRADEMARK OFFICE

CERTIFICATE OF CORRECTION

PATENT NO. : 6,491,326 B1
DATED : December 10, 2002
INVENTOR(S) : Victor T. Massey et al.

It is certified that error appears in the above-identified patent and that said Letters Patent is hereby corrected as shown below:

Title page,
Item [73], Assignee, the city should read as -- "Colfax". --

Signed and Sealed this

Eighth Day of April, 2003

JAMES E. ROGAN
*Director of the United States Patent and Trademark Office*